US007022252B2

(12) United States Patent
Mochizuki et al.

(10) Patent No.: US 7,022,252 B2
(45) Date of Patent: Apr. 4, 2006

(54) PERMANENT MAGNETIC ALLOY AND BONDED MAGNET

(75) Inventors: Mitsuaki Mochizuki, Saitama (JP); Michihisa Shimizu, Saitama (JP); Tsunehiro Kawata, Saitama (JP); Masao Murakawa, Saitama (JP)

(73) Assignee: Hitachi Metals, Ltd., Tokyo (JP)

( * ) Notice: Subject to any disclaimer, the term of this patent is extended or adjusted under 35 U.S.C. 154(b) by 165 days.

(21) Appl. No.: 10/290,157

(22) Filed: Nov. 8, 2002

(65) Prior Publication Data

US 2003/0145910 A1 Aug. 7, 2003

(30) Foreign Application Priority Data

Nov. 9, 2001 (JP) ..... 2001-344772

(51) Int. Cl.
*H01F 1/057* (2006.01)

(52) U.S. Cl. ..... 252/62.54; 148/302; 148/101; 420/83; 420/121; 164/463

(58) Field of Classification Search ..... 148/302; 420/83, 121; 252/62.54
See application file for complete search history.

(56) References Cited

U.S. PATENT DOCUMENTS

| | | | | |
|---|---|---|---|---|
| 5,716,462 | A | 2/1998 | Sakurada et al. | |
| 5,968,289 | A | 10/1999 | Sakurada et al. | |
| 5,968,290 | A * | 10/1999 | Sakurada et al. | 148/302 |
| 6,406,559 | B1 * | 6/2002 | Sakurada et al. | 148/122 |
| 6,468,440 | B1 | 10/2002 | Sakurada et al. | |

FOREIGN PATENT DOCUMENTS

WO WO 99/50857 10/1999

* cited by examiner

*Primary Examiner*—John P. Sheehan
(74) *Attorney, Agent, or Firm*—Sughrue Mion, PLLC

(57) ABSTRACT

The permanent magnetic alloy of the present invention comprises an R—Fe—B alloy wherein R is at least one element selected from rare earth elements including Y. The R—Fe—B alloy has a composition mainly comprising Fe, substantially containing no N, and containing 4 at. % or more of B. The permanent magnetic alloy substantially comprises a $TbCu_7$ hard magnetic phase (main phase) and a fine crystal having an average crystal grain size of less than 5 nm and/or an amorphous phase, and has high magnetic properties.

7 Claims, 16 Drawing Sheets

PERMANENT MAGNETIC ALLOY AND BONDED MAGNET

BACKGROUND OF THE INVENTION

1. Field of the Invention

The present invention relates to a novel rare earth-Fe—B-based permanent magnetic alloy with high magnetic properties having a $TbCu_7$ hard magnetic phase as a main phase, particularly, an R—Fe—Co-M-B-based permanent magnetic alloy (wherein R is at least one rare earth element including Y with 70 at. % or more thereof being occupied by Sm, and M is at least one element selected from the group consisting of Nb, Ti, Zr, Hf, V, Mo, Cr, and Mn), and relates to a novel, high performance bonded magnet comprising the permanent magnetic alloy bonded with a binder.

2. Description of the Prior Art

Conventionally known rare earth magnet materials include Sm—Co-based magnet materials, Nd—Fe—B-based magnet materials, and Sm—Fe—N-based magnet materials. The Sm—Co-based magnet material is thermally little affected in its magnetic properties, but less practicable as isotropic magnet materials because the maximum energy product (BH)max is smaller than that of the Nd—Fe—B-based magnet materials. The Nd—Fe—B-based magnet material is now a main material for the rare earth bonded magnets because of their high magnetic properties, but has a drawback of a thermal change of magnetic properties larger than that of the Sm—Co-based magnet materials. The Sm—Fe—N-based magnet materials have magnetic properties comparable to those of the Nd—Fe—B-based magnet materials and have a merit of having magnetic properties thermally less affected than in the Nd—Fe—B-based magnet materials.

The demand for even more enhancing the performance of known rare earth magnet materials has become increasingly severe, and the magnetic properties thereof attained now appear to closely approach their limit. In view of these circumstances, a novel rare earth magnet material with high performance has been desired.

U.S. Pat. No. 5,716,462 discloses in Example 1 that an alloy hot melt corresponding to the following composition was quenched by ejecting it over a single cooling copper roll rotating at a peripheral speed of 40 m/s, thereby obtaining a thin alloy ribbon having a composition of $Sm_{7.35}Zr_{2.45}Co_{26.5}B_{1.88}Fe_{bal.}$ (B/Sm=0.26). The quenched thin alloy ribbon is then heat-treated in vacuum at 720° C. for 15 min. The result of X-ray diffraction on the thin alloy ribbon after the heat treatment shows diffraction peaks attributable to the $TbCu_7$ phase (main phase) and minute α-Fe diffraction peaks. The thin alloy ribbon after the heat treatment is then pulverized in a mortar into powder having a particle size of 100 μm or less. After mixing the resultant powder of magnetic material with 2% by mass of an epoxy resin, the mixture is compression-molded under a pressure of 784 MPa. The molded body is cured at 150° C. for 2.5 h. The magnetic properties at room temperature of the bonded magnet thus prepared are 0.75 T for the remanent magnetic flux density Br, 210 kA/m for the coercive force Hcj, and 64 kJ/mm$^3$ for the maximum energy product (BH)max.

U.S. Pat. No. 5,716,462 further discloses in Example 2 as follows. The thin alloy ribbon obtained above by heat-treating in vacuum at 720° C. for 15 min is pulverized into powder having a particle size of 32 μm or less, followed by a nitriding treatment (heat treatment) in a nitrogen gas atmosphere under 1 atm at 440° C. for 65 h to obtain a magnetic nitride powder having a composition of $Sm_{6.76}Zr_{2.25}Co_{24.35}B_{1.70}N_{8.12}Fe_{bal.}$ (B/Sm=0.25). The content of fine powder having a particle size of 3.8 μm or less is reduced to 5% by volume or less of the magnetic nitride powder. After mixed with 2% by mass of an epoxy resin, the resultant powder of magnetic material is compression-molded under a pressure of 784 MPa. The molded body was cured at 150° C. for 2.5 h. The magnetic properties at room temperature of the bonded magnet thus prepared were 0.75 T for Br, 560 kA/m for Hcj, and 81 kJ/mm$^3$ for (BH)max.

Upon comparing Examples 1 and 2 of U.S. Pat. No. 5,716,462, it can be found that the alloy composition of the powder of magnetic material has been so selected as to exhibit highest magnetic properties when subjected to the nitriding treatment. However, it has not been discovered that a novel permanent magnetic alloy having high magnetic properties, which substantially comprises a $TbCu_7$ hard magnetic phase (main phase) and a fine crystal having an average crystal grain size of less than 5 nm and/or an amorphous phase, can be obtained by quenching a melt having a composition corresponding to that of the permanent magnetic alloy of the present invention to prepare a thin alloy ribbon, followed by a heat treatment in a non-oxidative atmosphere substantially free from nitrogen. In addition, it is not disclosed that the magnetic properties are significantly improved by regulating a B/R ratio (atomic % ratio) of the permanent magnetic alloy within the range of the present invention. In the present invention, it is important for enhancing the magnetic properties to limit a N content range of the permanent magnetic alloy. This important feature is also not disclosed therein.

International publication WO 99/50857 discloses in claim 18 a quenched alloy having $TbCu_7$ crystal phase as a main phase and a composition represented by the following formula: $R^1_XR^2_YB_ZT_{100-X-Y-Z}$, wherein $R^1$ is at least one element selected from rare earth elements, $R^2$ is at least one element selected from Zr, Hf and Sc, T is at least one element selected from Fe and Co, and X, Y and Z are numbers satisfying 2 at. %≦X, 0.01 at. %≦Y,4≦X+Y≦20 at. %, and 0≦Z≦10 at. %. However, the proposed quenched alloy requires a subsequent nitriding treatment to acquire intended magnetic properties. In this point, the proposed quenched alloy is distinguished from the permanent magnetic alloy of the present invention. Thus, WO 99/50857 fails to disclose the features of the permanent magnetic alloy of the present invention, namely, the micro structure comprising a $TbCu_7$ hard magnetic phase (main phase) and a fine crystal having an average crystal grain size of less than 5 nm and/or an amorphous phase; the B/R ratio (atomic % ratio) regulated with the range of 0.30≦B/R≦2.5; and the nitrogen content regulated less than 0.1 at. %.

U.S. Pat. No. 5,968,289 discloses in claim 1 a permanent magnetic material having a $TbCu_7$ crystal structure as the main phase and a composition represented by the following formula: $R1_xR2_yA_zO_uB_vM_{100-x-y-z-u-v}$, wherein R1 is at least one element selected from rare-earth elements including Y; R2 is at least one element selected from Zr, Hf and Sc; A is at least one element selected from H, N, C and P; M is at least one element selected from Fe and Co; and x, y, z, u and v are each atomic % defined by 2≦x, 0.01≦y, 4≦x+y≦20, 0.001≦z≦10, 0.01≦u≦2, and 0<v≦10. However, U.S. Pat. No. 5,968,289 fails to disclose the features of the permanent magnetic alloy of the present invention, namely, the specific micro structure and the B/R ratio (atomic % ratio) regulated within the range of 0.30≦B/R≦2.5.

SUMMARY OF THE INVENTION

An object of the present invention is to provide a novel, high-performance rare earth permanent magnetic alloy and a high-performance bonded magnet made therefrom, each capable of meeting the recent severe demands for improving the magnetic properties of rare earth permanent magnetic materials.

The object has been attained by a permanent magnetic alloy comprising an R—Fe—B alloy wherein R is at least one element selected from rare earth elements including Y, the R—Fe—B alloy having a composition mainly comprising Fe, substantially containing no N and containing 4 at. % or more of B, and substantially comprising a $TbCu_7$ hard magnetic phase (main phase) and a fine crystal having an average crystal grain size of less than 5 nm and/or an amorphous phase. The term "at. %" referred to herein is percentage based on the total number of atoms of the elements constituting the magnetic alloy, unless otherwise specified.

The permanent magnetic alloy is highly practical because of its high magnetic properties when having a basic composition represented by the formula: $R_xFe_{100-x-y-z-w}Co_yM_wB_z$, wherein R is at least one element selected from rare earth elements including Y and 70 at. % or more of R is occupied by Sm; M is at least one element selected from the group consisting of Nb, Ti, Zr, Hf, V, Mo, Cr and Mn; and x, y, z and w are atomic percentages satisfying the equations of $4 \leqq x \leqq 11$, $0 \leqq y \leqq 30$, $4 \leqq z \leqq 11$, and $0 \leqq w \leqq 8$.

High magnetic properties are also attained when a content (w) of M in the permanent magnetic alloy is $0.5 \leqq w \leqq 8$, and a content of M in the fine crystal having an average crystal grain size of less than 5 nm and/or the amorphous phase is higher than a content of M in the $TbCu_7$ hard magnetic phase (main phase).

The permanent magnetic alloy is of high industrial productivity because it may have a basic composition represented by the formula:

$R_xFe_{100-x-y-z-w-v}Co_yM_wB_zA_v$, wherein R is at least one element selected from rare-earth elements including Y and 70 at. % or more of R is occupied by Sm; M is at least one element selected from the group consisting of Nb, Ti, Zr, Hf, V, Mo, Cr and Mn; A is Al and/or Si; and x, y, z, w and v are atomic percentages satisfying $4 \leqq x \leqq 11$, $0 \leqq y \leqq 30$, $4 \leqq z \leqq 11$, $0.5 \leqq w \leqq 8$, and $0 < v \leqq 2$.

The permanent magnetic alloy is also high in industrial productivity when its basic composition is represented by the formula:

$R_xFe_{100-x-y-z-w-v-u}Co_yM_wB_zA_vN_u$, wherein R is at least one element selected from rare-earth elements including Y and 70 at. % or more of R is occupied by Sm; M is at least one element selected from the group consisting of Nb, Ti, Zr, Hf, V, Mo, Cr and Mn; A is Al and/or Si; and x, y, z, w, v and u are atomic percentages satisfying $4 \leqq x \leqq 11$, $0 \leqq y \leqq 30$, $4 \leqq z \leqq 11$, $0.5 \leqq w \leqq 8$, $0 \leqq v \leqq 2$, and $0.0001 < u < 0.1$.

The permanent magnetic alloy of the present invention is further characterized by having a basic composition represented by the formula:

$R_xFe_{100-x-y-z-w}Co_yM_wB_z$, wherein R is at least one element selected from rare earth elements including Y; M is at least one element selected from the group consisting of Nb, Ti, Zr, Hf, V, Mo, Cr and Mn; and x, y, z and w are atomic percentages satisfying $4 \leqq x \leqq 11$, $0 \leqq y \leqq 30$, $4 \leqq z \leqq 11$, and $0 \leqq w \leqq 8$, and by comprising a $TbCu_7$ hard magnetic phase as a main phase.

The permanent magnetic alloy exhibits high magnetic properties when having a basic composition represented by the formula:

$R_xFe_{100-x-y-z-w-u}Co_yM_wB_zN_u$, wherein R is at least one element selected from rare earth elements including Y and 70 at. % or more of R is occupied by Sm; M is at least one element selected from the group consisting of Nb, Ti, Zr, Hf, V, Mo, Cr and Mn; and x, y, z, w and u are atomic percentages satisfying $4 \leqq x \leqq 11$, $0 \leqq y \leqq 30$, $4 \leqq z \leqq 11$, $0 \leqq w \leqq 8$, and $0.0001 < u < 0.1$.

The permanent magnetic alloy is of high industrial productivity because it may have a basic composition represented by the formula:

$R_xFe_{100-x-y-z-w-u-v}Co_yM_wB_zA_vN_u$, wherein R is at least one element selected from rare earth elements including Y and 70 at. % or more of R is occupied by Sm; M is at least one element selected from the group consisting of Nb, Ti, Zr, Hf, V, Mo, Cr and Mn; A is Al and/or Si; and x, y, z, w, u and v are atomic percentages satisfying $4 \leqq x \leqq 11$, $0 \leqq y \leqq 30$, $4 \leqq z \leqq 11$, $0 \leqq w \leqq 8$, $0.0001 < u < 0.1$, and $0 < v \leqq 2$.

The permanent magnetic alloy of the present invention is a thin alloy ribbon (strip) having an average thickness of exceeding 30 μm, which is subjected to a heat treatment in a non-oxidative atmosphere containing substantially no nitrogen. The thin alloy ribbon contains a $TbCu_7$ hard magnetic phase (main phase) having an average crystal grain size of 5 to 80 nm and has a coercive force Hcj of 238.7 kA/m or more at room temperature. Thus, since the thin alloy ribbon of the present invention is fairly thick and has high magnetic properties, it is suitable for magnetic powder for use in bonded magnets.

The bonded magnet of the present invention is characterized by comprising an permanent magnetic alloy bonded with a binder, wherein the permanent magnetic alloy comprising an R—Fe—B alloy wherein R is at least one element selected from rare earth elements including Y, the R—Fe—B alloy having a composition mainly comprising Fe, substantially containing no N and containing 4 at. % or more of B, and substantially comprising a $TbCu_7$ hard magnetic phase (main phase) and a fine crystal having an average crystal grain size of less than 5 nm and/or an amorphous phase.

The bonded magnet of the present invention is also characterized by comprising an permanent magnetic alloy bonded with a binder, wherein the permanent magnetic alloy comprises a $TbCu_7$ hard magnetic phase as a main phase and has a basic composition represented by the formula:

$R_xFe_{100-x-y-z-w}Co_yM_wB_z$, wherein R is at least one element selected from rare earth elements including Y; M is at least one element selected from the group consisting of Nb, Ti, Zr, Hf, V, Mo, Cr and Mn; x, y, z and w are atomic percentages satisfying $4 \leqq x \leqq 11$, $0 \leqq y \leqq 30$, $4 \leqq z \leqq 11$, and $0 \leqq w \leqq 8$; and B and R satisfy $0.30 \leqq B/R \leqq 2.5$ wherein B/R is an atomic percent ratio of B and R.

DETAILED DESCRIPTION OF THE INVENTION

The composition of the permanent magnetic alloy of the present invention has been selected on the basis of the following reasons.

Figure 8:
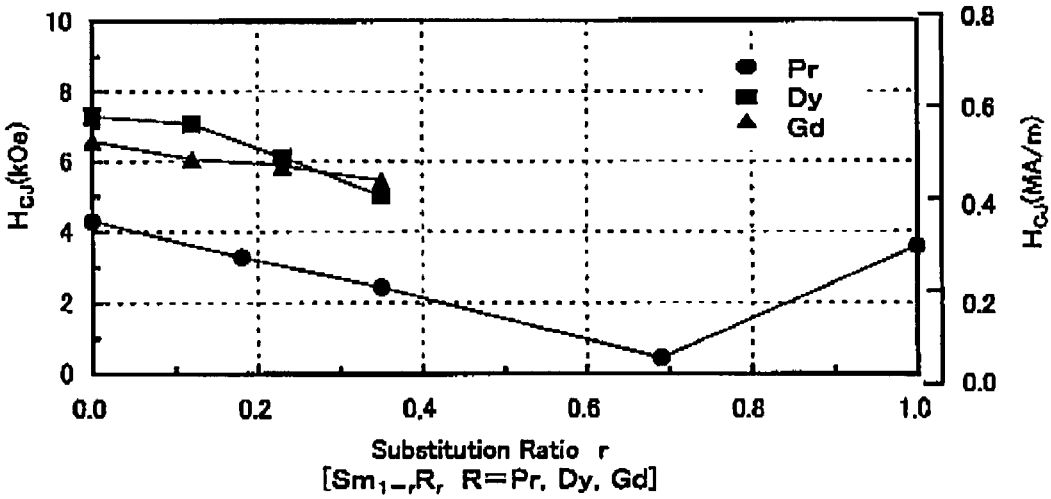
FIG. 8 is a graph showing one example of the magnetic properties when substituting a rare earth element other than Sm for R.

R is at least one rare earth element including Y, preferably R indispensably include Sm and may additionally include at least one rare earth element selected from the group consisting of Y, La, Ce, Pr, Nd, Eu, Gd, Tb, Dy, Ho, Er, Tm, Yb and Lu. R is preferably occupied by Sm in 70 at. % or more, more preferably 90 at. % or more. Most preferably, R is Sm excepting inevitable rare earth element other than Sm. For example, as shown in FIG. 8 to be mentioned below, Hcj is significantly lowered to make the practical use difficult when the Sm content in R is reduced to less than 70 at. %, namely, the Dy content exceeds 30 at. %, by replacing a portion of Sm with Dy.

The content of R (x) is $4 \leqq x \leqq 11$, preferably $5 \leqq x \leqq 9$, more preferably $5.5 \leqq x \leqq 8$. If x is smaller than 4, the $TbCu_7$ crystal (hard magnetic phase) does not precipitate, and α-(Fe, Co) precipitates instead to largely reduce Hcj. If x is larger than 11, $Sm_2(Fe, Co)_{14}B_1$ precipitates to largely reduce Hcj.

The content of Fe is 62 to 92 at. %. If exceeding 92 at. %, Hcj is largely reduced because the $TbCu_7$ hard magnetic phase less precipitates and the precipitation of α-(Fe, Co) becomes relatively considerable.

By replacing a part of Fe with Co, Hcj and the saturated magnetic flux density are enhanced and the Curie temperature is increased. Since the permanent magnetic alloy of the present invention has a coercive force of Hcj≧238.7 A/m at room temperature even when the content of Co (y) is zero, the lower limit of y is set to 0 at. %. The upper limit of y is 30 at. %. If y exceeds 30 at. %, Hcj and saturated magnetic flux density are significantly reduced. Thus, the content of Co is $0 \leqq y \leqq 30$, preferably $1 \leqq y \leqq 25$, more preferably $5 \leqq y \leqq 25$. The corrosion resistance can be improved by replacing a part of Fe or Co with Ni up to 10 at. %.

M is at least one element selected from the group consisting of Nb, Ti, Zr, V, Hf, Mo, Cr and Mn, with Nb, Ti, V and Zr being preferred and Nb being more preferred. M element enhances the formation of the amorphous phase in a process of quenching a hot melt, and also contribute to stabilizing the $TbCu_7$ phase precipitated in the process of heat treatment. Namely, M has an effect of increasing Hcj by preventing the transformation to the $Sm_2(Fe, Co)_{14}B_1$, phase. As will be described in Example 13 below, M element in the permanent magnetic alloy of the present invention is found to form a solid solution with the precipitated crystalline phase or the remaining amorphous phase. The content of M element (w) is $0 \leqq w \leqq 8$, preferably $0.5 \leqq w \leqq 8$, more preferably $0.5 \leqq w \leqq 6$, and particularly preferably $2 \leqq w \leqq 5$. The permanent magnetic alloy of the present invention has a coercive force of Hcj≧238.7 A/m at room temperature even when w is zero. However, since Hcj as high as possible is required in view of practical use, w is preferably set within the above ranges. If w exceeds 8 at. %, Br and (BH)max are significantly reduced.

The corrosion resistance or mechanical strength may be improved by replacing a part of M element with at least one element selected from the group consisting of Ga, Ta, W, Sb, In and Bi in a proportion of exceeding 0 at. % and up to 2 at. %.

B is an indispensable element of the permanent magnetic alloy of the present invention, because an amount of B remarkably enhances the formation of amorphous phase and the retention of amorphous phase. If the content of B (z) is less than 4 at. %, the formation of amorphous phase by quenching is difficult. For example, in a liquid quenching method (single roll method), an alloy ribbon (strip) after quenching becomes insufficiently amorphous if the cooling roll (made of copper alloy) is not set at a peripheral speed exceeding 30 m/s. More importantly, the fine crystal having an average crystal grain size of less than 5 nm and/or the amorphous phase disappear upon heat-treating the quenched thin alloy ribbon in an non-oxidative atmosphere substantially containing no nitrogen. In addition, the $TbCu_7$ crystal gains are coarsened to promote the precipitation of α-(Fe, Co), resulting in a significant decrease of Hcj. If z exceeds 11 at. %, the $TbCu_7$ phase is not formed, and instead, soft magnetic crystals such as $Sm_2(Fe, Co)_{23}B_3$ precipitate to fail to attain hard magnetic properties. Therefore, the content of B is set to $4 \leqq z \leqq 11$, preferably $5 \leqq z \leqq 10.5$, and more preferably $6 \leqq z \leqq 10$.

The B/R ratio (atomic percent ratio) is a parameter expressing the ease of existence of the fine crystal having an average crystal grain size of less than 5 nm and/or the amorphous phase as well as the $TbCu_7$ phase. The B/R ratio is 0.30 to 2.5, preferably 0.4 to 2.0, and more preferably 0.45 to 1.5. If the B/R ratio is less than 0.30 or more than 2.5, Hcj decreases to less than 238.7 kA/m to become poor in practical use. In addition, the fine crystal and/or the amorphous phase hardly coexist with the $TbCu_7$ phase.

The content of N (u) is more than 0.0001 at. % and less than 0.1 at. %, preferably 0.0003 to 0.01 at. %, and more preferably 0.0006 to 0.08 at. %. It is industrially difficult to achieve a content u of less than 0.0001 at. %, and Hcj is largely decreased if exceeding 0.1 at. %.

Al and Si are inevitable elements from a crucible. When an alumina ($Al_2O_3$) crucible or a quartz ($SiO_2$) crucible is used, R component in a hot melt reduces Al or Si contained in the crucible. The reduced Al or Si enters into the hot melt to contaminate the final thin alloy ribbon. Therefore, it is important for the industrial production to clarify the influence of the contaminant Al or Si. In the permanent magnetic alloy of the present invention, the content of Al and/or Si (v) is more than 0 at. % and 2 at. % or less, preferably 0.1 to 1.5 at. %. An Al and/or Si content of more than 2 at. % remarkably reduces Hcj. It is industrially difficult to make the amount of contaminant zero.

The permanent magnetic alloy of the present invention is allowed to further contain, in addition to Al and Si, other inevitable impurities such as C, O, P, S and H to a certain extent. The content of such impurities is preferred to be limited to 2 at. % or less (exclusive of zero) in total.

The micro structure of the permanent magnetic alloy will be described below.

The words "substantially comprising a $TbCu_7$ hard magnetic phase (main phase) and a fine crystal having an average crystal grain size of less than 5 nm and/or an amorphous phase" referred to herein mean that the permanent magnetic alloy of the present invention contains the $TbCu_7$ crystal (hard magnetic phase) as the main phase and may partly contain $ThMn_{12}$ crystal, $Th_2Zn_{17}$ crystal, $Th_2Ni_{17}$ crystal or α-(Fe, Co) crystal. These crystals, other than α-(Fe, Co) crystal, are capable of coexisting with each other because they are interconvertible by replacing R cites of $CaCu_5$ fundamental structure with a dumbbell (pair of two atoms) of transition metal such as Fe and Co according to the replacement ratio and the long-range order parameter at the replaced position (replacement pattern). The content of the $TbCu_7$ hard magnetic phase (main phase) is more than 50% by volume and less than 100% by volume, and preferably 60 to 95% by volume of the permanent magnetic alloy.

The amorphous phase present in the permanent magnetic alloy is a soft magnetic phase. When the R content and the B content are small, α-(Fe, Co) phase (soft magnetic phase) precipitates. A phase, originally a hard magnetic phase, comes to exhibit a soft magnetic behavior because of enhanced exchange interaction between crystal grains when the average crystal grain size is smaller than 5 nm.

The average crystal grain size of the $TbCu_7$ crystal (main phase) in the permanent magnetic alloy is 5 to 80 nm, preferably 8 to 40 nm, and more preferably 10 to 20 nm. It is practically impossible to attain an average crystal grain size of less than 5 nm. An average crystal grain size of grater than 80 nm makes it difficult to put the permanent magnetic alloy into practical use because of a drastic decrease of Hcj. The average crystal grain size of the $TbCu_7$ crystal can be determined from a photograph of the cross-sectional structure of the permanent magnetic alloy taken by transmission electron microscope (TEM). Specifically, by taking the number of the $TbCu_7$ crystal grains counted in the measuring field of the cross-sectional photograph as n (about 50) and the total cross-sectional area of n crystal grains as s, an average cross-sectional area (s/n) per one crystal grain is calculated. The average crystal grain size (D) is defined as the diameter of a circle having the area of s/n, as calculated from the equation (1):

$$\pi(D/2)^2 = s/n.$$

Although the mechanism has not yet been clarified, it has been found that high magnetic properties are attained when the fine crystal having an average crystal grain size of less than 5 nm and/or the amorphous phase coexist with the $TbCu_7$ crystal (main phase). It has been further found that Hcj tends to be increased when the fine crystal having an average crystal grain size of preferably 3 nm or less, more preferably 2 nm or less and/or the amorphous phase coexist with the $TbCu_7$ crystal (main phase).

The identification of the fine crystal having an average crystal grain size of less than 5 nm and/or the amorphous phase and the determination of the average crystal grain size of the fine crystal can be conducted, as will be illustrated in Example 13 below, by analyzing nano electron diffraction patterns that are obtained by varying the spot diameter of the irradiation beam within the range of 1 to 5 nm.

The conditions for producing the permanent magnetic alloy of the present invention will described below.

First, an ingot of a predetermined composition is prepared by an arc melting or an high-frequency melting. Considering the evaporation of Sm, the melting process of ingot is preferably carried out in argon gas atmosphere. Then, the ingot is cut into pieces and melted by a high-frequency induction heating. The quenching method of the hot melt thus obtained may include a single roll method, a twin roll method, a splat quenching method, a rotary disk method and a gas atomizing method. The single roll method is practicable, although not limited thereto.

The production method by quenching a hot melt by a single roll method will be described below. The solidification speed of hot melt by quenching is nearly proportional to the peripheral speed of a cooling roll (made of a copper alloy). The peripheral speed of the cooling roll is, but not limited to, preferably 5 to 30 m/s, and more preferably 10 to 20 m/s. Namely, as compared with the peripheral speed (40 to 75 m/s) of a cooling roll employed in the production of a quenched thin ribbon for $TbCu_7$-type Sm—Fe—N nitride magnetic materials by a single roll method, a lower liquid quenching speed is sufficient for the present invention, this increasing the industrial productivity of the present invention. This is because that a high B content and a suitable amount of the optional M element of the permanent magnetic alloy of the present invention allow a quenched thin ribbon (strip) to easily become amorphous. Generally, the thickness of a quenched thin ribbon reduces to less than 30 μm when the peripheral speed of cooling roll exceeds 30 m/s, thereby deteriorating the compressibility of the magnetic powder for bonded magnets to be obtained by a subsequent heat treatment and pulverization. A bonded magnet made of such a magnetic powder, as shown in Comparative Example 1 below, has a low density to reduce (BH)max.

Next, the quenched thin ribbon (strip) is heat-treated for crystallization. The heat treatment should be carried out in a non-oxidative atmosphere substantially containing no nitrogen. The words "substantially containing no nitrogen" referred to herein mean that nitrogen may be contained in an amount acceptable as impurity. The heat treatment is preferably carried out in an argon atmosphere in practice, but may be carried out in a helium atmosphere or in vacuum. Sm used as the principal element of the permanent magnetic alloy of the present invention has a high vapor pressure. Therefore, a long-term heat treatment strengthens a tendency to form a Sm-deficient layer, i.e., a Fe(Co)-rich soft magnetic layer, in the quenched thin ribbon from its surface to a depth of 2 to 3 μm. The higher the volume ratio of the soft magnetic layer, i.e., the thinner the thin alloy ribbon under heat treatment, the more the volume ratio of the surface soft magnetic layer increases relative to the inner parts having a normal concentration of Sm, resulting in the occurrence of knick point in a demagnetization curve to deteriorate the squareness. However, the permanent magnetic alloy of the present invention exhibits high magnetic properties even at a thickness exceeding 30 μm and has a superior squareness of the demagnetization curve, showing the excellency over conventional magnetic materials. To prevent the escape of Sm by evaporation, the quenched thin ribbon is preferably heat-treated in the presence of a Sm-source alloy in an inert gas atmosphere substantially containing no nitrogen. Alternatively, the heat treatment is effectively carried out on the quenched thin ribbons packed into a heat treatment container in bulky manner.

The heat treatment temperature is preferably 550 to 750° C., and more preferably 600 to 700° C. A heat treatment temperature lower than 550° C. makes the precipitation of the $TbCu_7$ crystal from the amorphous phase insufficient to result in a very low Hcj. A heat treatment temperature higher than 750° C. coarsens the $TbCu_7$ crystal grain, or allows the precipitation of $R_2Fe_{14}B_1$ crystal or $ThMn_{12}$ crystal to cause a significant decrease of magnetic properties. The heat treatment time is from one minute to 50 h, preferably 30 min to 30 h, although varies depending on the heat treatment temperature.

The bonded magnet of the present invention will be described below.

As the magnetic powder for bonded magnets, usable are as heat-treated thin alloy ribbon or an alloy powder prepared by pulverizing the heat-treated thin alloy ribbon followed by classification into an intended particle size distribution. The pulverization method is not particularly limited, and various pulverizers such as a bantam mill, a pin mill, a ball mill and a jet mill. The pulverization is carried out in an inert gas atmosphere such as argon and nitrogen to prevent the oxidation.

The average particle size of the magnetic powder for bonded magnets (measured by a laser diffraction particle size analyzer "HEROS/RODOS System" manufactured by Sympatec Co., Ltd.) is 5 to 200 μm, preferably 10 to 150 μm, although not limited thereto. If smaller than 5 μm, the compressibility of the magnetic powder is extremely lowered and the oxidation becomes considerable to result in a bonded magnet having an extremely low (BH)max. If larger than 200 μm, the surface of the bonded magnet is roughened although a high density is attained, thereby making in some cases the bonded magnet inapplicable to the use requiring a strict control of magnetic gap.

The bonded magnet of the present invention is produced by binding the heat-treated permanent magnetic alloy or the pulverized magnetic powder prepared therefrom with a binder. Usable as the binder may include a thermosetting resin, a thermoplastic resin, a rubber material and a low-melting alloy, with the thermosetting resin, the thermoplastic resin and the rubber material being preferred in view of their high practicability.

The permanent magnetic alloy or its pulverized magnetic powder is blended with a binder in a prescribed ratio, and then molded into a bonded magnet, followed by a heat treatment for stress relaxation or a curing treatment, if necessary. These heat treatments are preferably carried out at 50 to 250° C. for 0.5 to 10 h in the air or in an inert gas atmosphere.

The mixing ratio of the heat-treated permanent magnetic alloy or its pulverized magnetic powder to the binder is 80:20 to 99:1, preferably 90:10 to 98.5:1.5 by weight, although not limited thereto. If less than 80, the magnetic properties of the bonded magnet are drastically reduced. If more than 99, it becomes difficult to meet the required strength, etc. of the bonded magnet.

The bonded magnet of the present invention may be produced by a compression molding, an injection molding, an extrusion molding or a calender roll molding. In the compression molding, the thermosetting resin is suitable as the binder. Particularly preferred is a liquid epoxy resin because of its low costs, ease of handling and good heat resistance.

The bonded magnet of the present invention is preferably surface-treated by a known method to improve the corrosion resistance. For example, but not limited to, an epoxy resin is coated in an average thickness of 5 to 30 μm.

The present invention will be explained in more detail by reference to the following examples which should not be construed to limit the scope of the present invention.

EXAMPLE 1

The relationships between the content of B and the magnetic properties when M was Nb were examined. Respective amounts of samarium metal pieces, electrolytic iron pieces, cobalt metal pieces, niobium metal pieces and crystal boron pieces were arc-melted in a pressure-reduced argon gas atmosphere to prepare several button ingots having different contents of B and Co. The Sm was weighed by 5% by mass more than the intended amount because of its great ease of escaping by evaporation. In the arc melting process, a melting-solidification cycle was repeated four times while turning over each button ingot in every cycle to obtain homogeneous ingots. Each of the ingots thus prepared was disintegrated into pieces, and 8.5 g thereof were placed into a quartz tube nozzle (diameter: 1 cm; nozzle diameter: 0.8 cm), which was then set to a single roll liquid quenching apparatus (NEV-A1 Model manufactured by Nisshin Giken Co., Ltd.) with a gap of 0.2 mm between the quartz tube nozzle and a cooling roll (made of copper alloy; diameter: 20 cm). In a chamber of a pressure-reduced argon atmosphere (80 kPa), the ingot pieces in the quartz tube were melted by high-frequency heating to a hot melt. The hot melt was ejected onto the cooling roll rotating at a peripheral speed of 16 m/s by applying an argon gas pressure of 105 kPa to the hot melt (pressure difference: 25 kPa), thereby preparing thin alloy ribbons (strips) of 1 to 2 mm wide and 47 μm thick in average. By ICP analysis, the composition of the quenched thin alloy ribbon was found to be $Sm_{6.6}Fe_{bal.}Co_yNb_{2.7}Si_{0.15}B_xN_{0.001}$(y=12.2, or 16.4 at. %, x=0 to 15.5 at. %).

Figure 1:
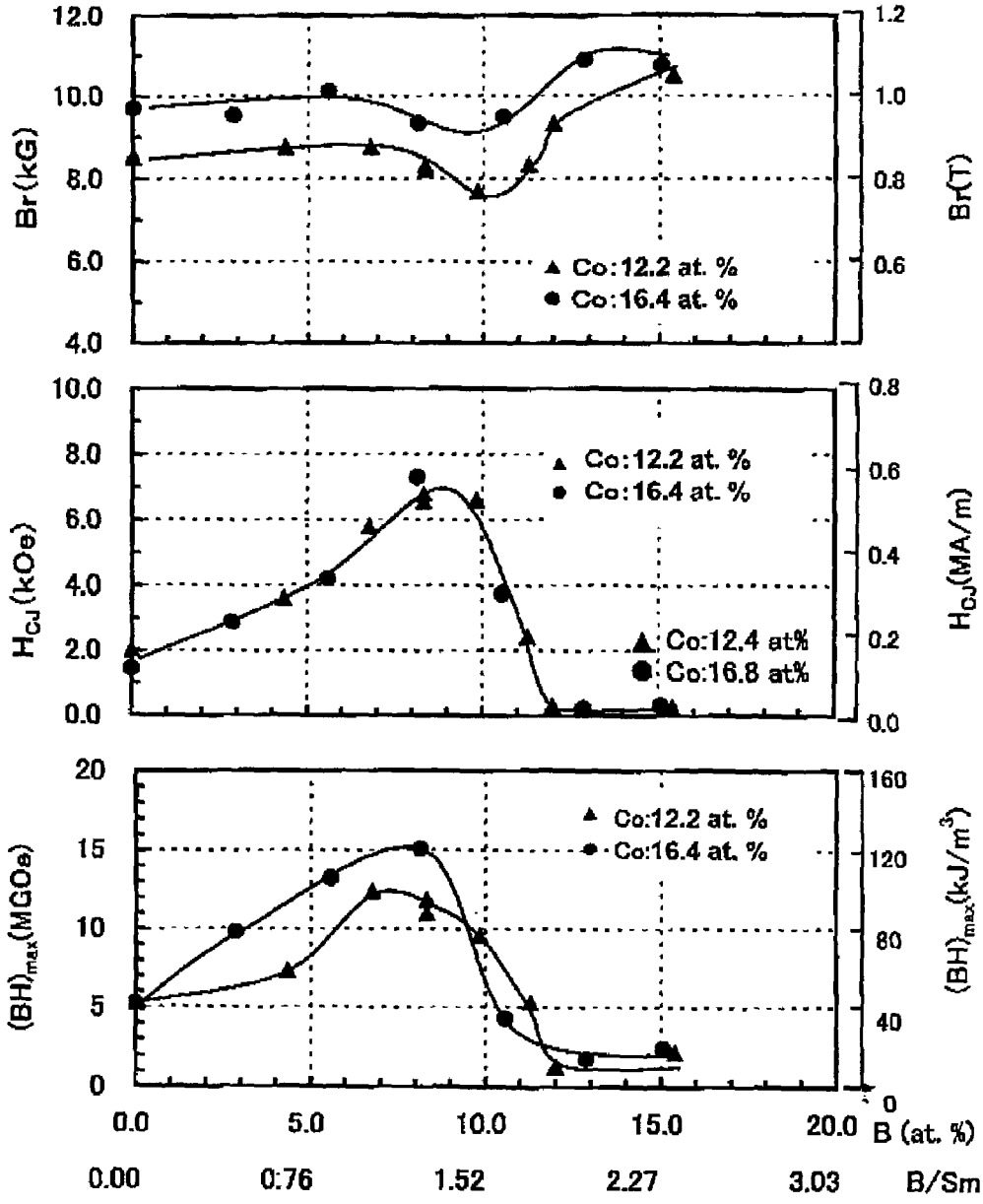
FIG. 1 is a graph showing one example of the relationship between the content of B, (B/Sm) and the magnetic properties.

The thin alloy ribbons were cut to about 3 cm long, wrapped with niobium foil and SUS foil, and heat-treated in a tubular furnace of an argon atmosphere at 640° C. for 2.5 h for the ribbons of y=12.2 at. % or at 640° C. for 2.5 h for the ribbons of y=16.4 at. %. The heat-treated thin alloy ribbons were cut to 6 mm long, and 4 to 5 thin alloy ribbon pieces (about 10 mg) were put on an adhesive sheet into a shape of 4 mm×6 mm. A specimen was prepared by laminating two of such sheets. The magnetic properties of the specimen were measured by a vibrating magnetometer (VSM-5 Model manufactured by Toei Kogyo Co., Ltd.) at room temperature (20° C.) in a magnetization field of 1.6 MA/m. The density of the heat-treated thin alloy ribbon was measured by a gas replacement densimeter (Accupyc 1330 Model manufactured by Shimadzu Corporation). The relationships of the content of B to Hcj, Br and (BH)max at room temperature are shown in FIG. 1. The relationships of (B/Sm) to Hcj, Br and (BH)max at room temperature are also shown in FIG. 1.

As seen from FIG. 1, the thin alloy ribbon having a composition represented by the formula: $Sm_{6.6}Fe_{bal.}Co_yNb_{2.7}Si_{0.15}B_xN_{0.001}$ (y=12.2, or 16.4 at. %, x=0 to 15.5 at. %) exhibited Hcj of 238.7 kA/m or more when the content of B (x) was 4 to 11 at. %, and Hcj of 318.3 kA/m or more when the content of B was 5 to 10 at. %. Also, within the above content range of B, the specimen having a Co content (y) of 12.2 at. % exhibited Br of 0.78 to 0.87 T and (BH)max of 63.7 to 103.5 kJ/m$^3$, and the specimen wherein y is 16.4 at. % exhibited Br of 0.93 to 1.01 T and (BH)max of 95.5 to 119.4 kJ/m$^3$. It can be further seen that Hcj of 477.5 kA/m or more was attained when the content of B was 7 to 10 at. %, and Hcj of 238.7 kA/m was attained when (B/Sm) was 0.45 to 1.7.

Figure 2:
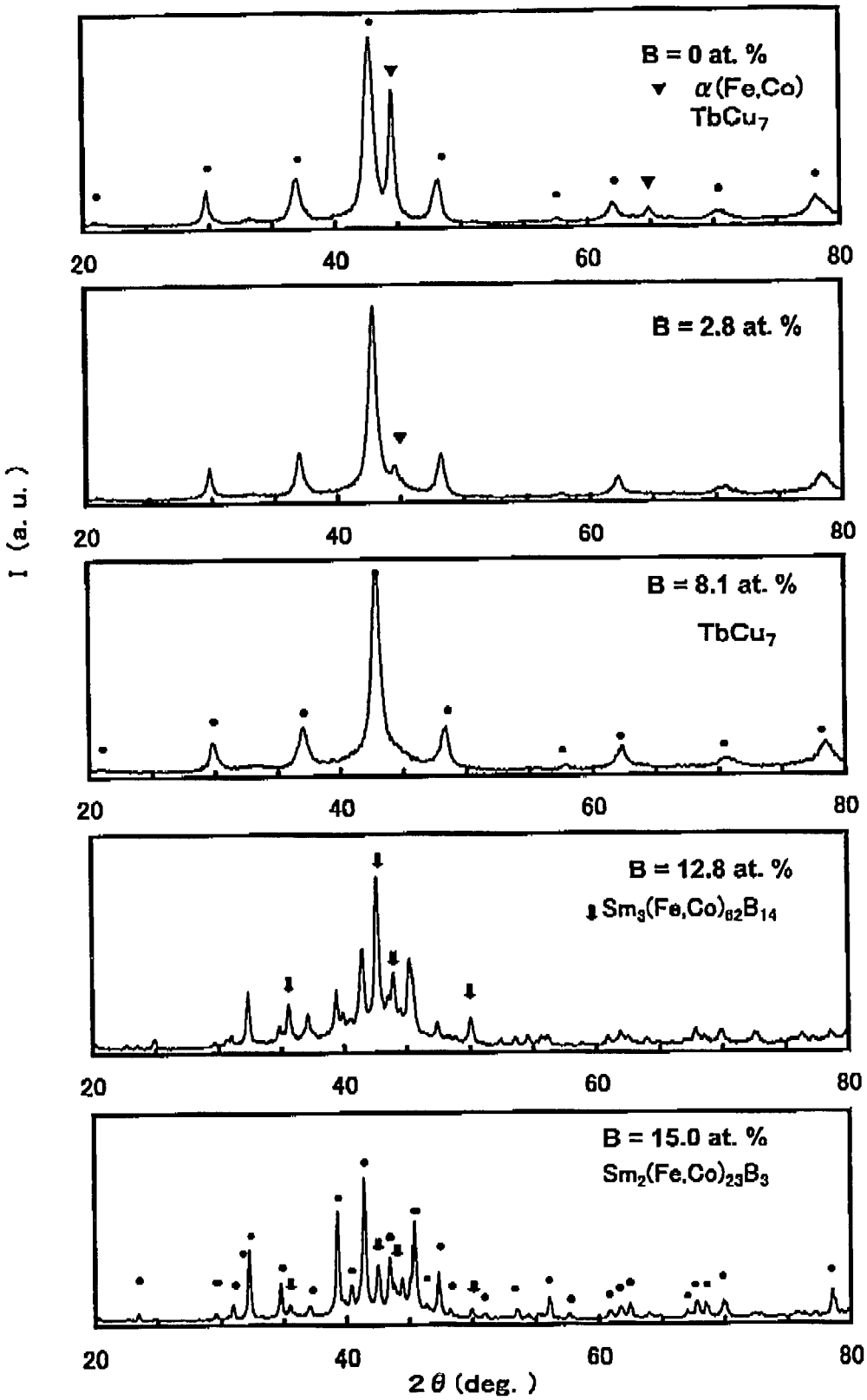
FIG. 2 is a graph showing one example of X-ray diffraction patterns of a heat-treated thin alloy ribbon.

From the heat-treated thin alloy ribbon having a Co content of 16.4 at. %, each of ribbons having respective B contents (x) of 0, 2.8, 8.1, 12.8 and 15.0 at. % was sampled and pulverized in a mortar to prepare a specimen for X-ray diffractometry. The results of X-ray diffraction made using an X-ray diffractometer (RINT2500 Model, Cukα) manufactured by Rigaku Denki Co., Ltd. are shown in FIG. 2. As seen from FIG. 2, the specimen having a B content of 8.1 at. % was of a single phase structure of $TbCu_7$ phase. The specimen having a B content of 2.8 at. % showed α-(Fe, Co) peaks in addition to the peaks assigned to the $TbCu_7$ structure. In the specimen having a B content of 15.0 at. %, a soft magnetic $Sm_2(Fe, Co)_{23}B_3$ precipitated as the main phase in stead of the $TbCu_7$ structure. $Sm_3(Fe, Co)_{62}B_{14}$ phase (indicated by arrows in FIG. 2), that was different from both the $TbCu_7$ crystal structure and the $Sm_2(Fe, Co)_{23}B_3$ phase, appeared in the specimen having a B content of 12.8 at. %. Thus, $Sm_2(Fe, Co)_{14}B_1$ phase was not observed in any of the specimens shown in FIG. 2.

EXAMPLE 2

Figure 3:
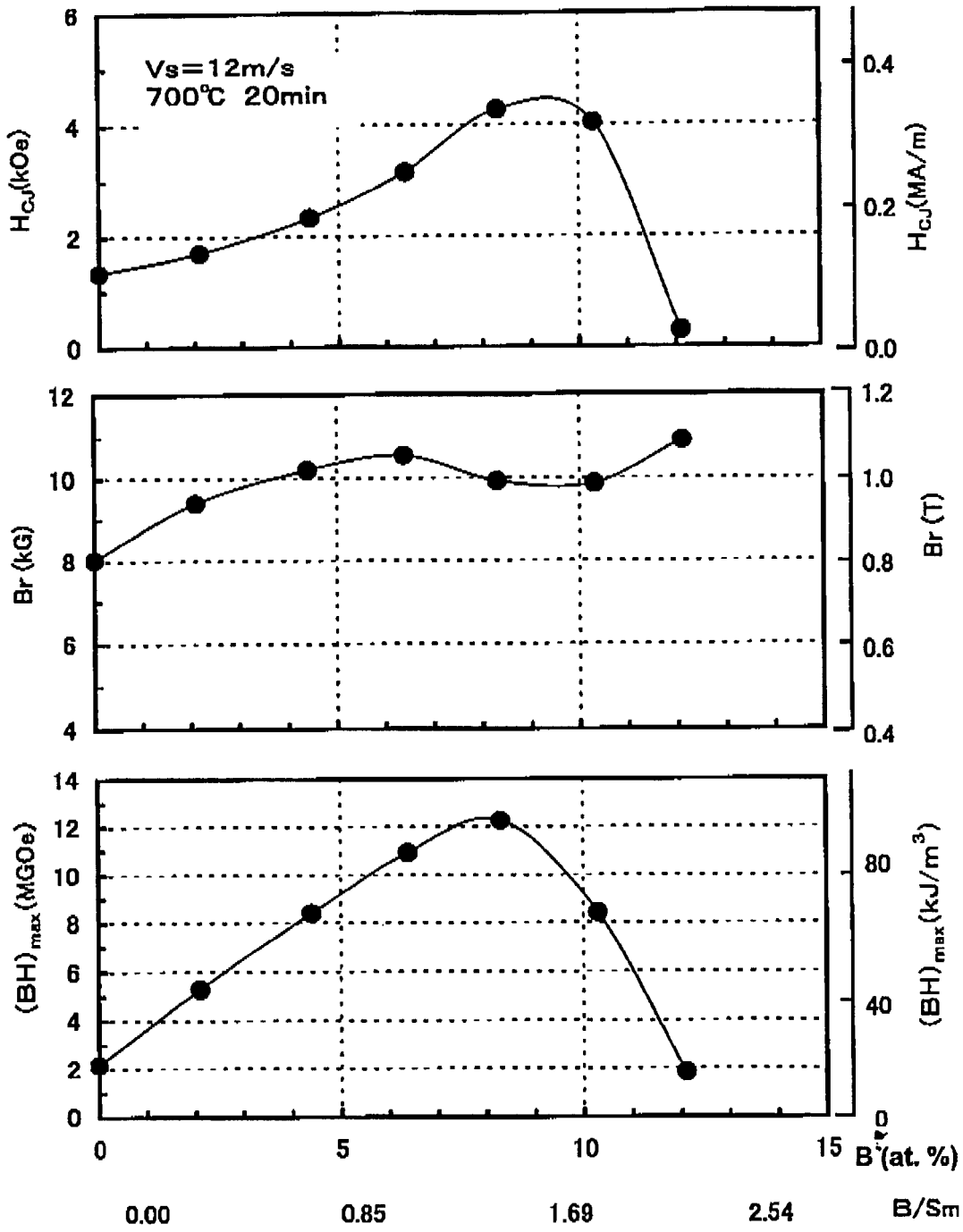
FIG. 3 is a graph showing another example of the relationship between the content of B, (B/Sm) and the magnetic properties.

The relationships between the B content and the magnetic properties when M was Zr were examined. Respective amounts of Sm, Fe, Co, Zr, B and Si were arc-melted to prepare ingots having different B contents. A hot melt of small pieces of each ingot prepared by high-frequency melting was ejected onto a cooling roll (made of copper alloy) rotating at a peripheral speed of 12 m/s in a single roll liquid quenching apparatus, thereby forming thin alloy ribbons of 1 to 2 mm wide and 50 to 60 μm thick in average. By ICP analysis, the composition of the quenched thin alloy ribbon was found to be $Sm_{5.9}Fe_{bal.}Co_{23.9}Zr_{2.0}Si_{0.45}B_xN_{0.001}$ (x =0 to 12.2 at. %). These thin alloy ribbons were heat-treated at 700° C. for 20 min in a furnace under an argon gas atmosphere. After treating the heat-treated thin alloy ribbons in the same manner as in Example 1, the magnetic properties were measured at room temperature. The relationships beteen the content of B and Hcj, Br and (BH)max of the thin alloy ribbons are shown in FIG. 3. The relationships between (B/Sm) and Hcj, Br and (BH)max are also shown in FIG. 3. As seen from FIG. 3, Hcj of 238.7 kA/m or more was attained when the content B was 6 at. % or more. Further, Hcj of 238.7 kA/m or more was attained when (B/Sm) was 1.0 to 1.9.

Figure 4:
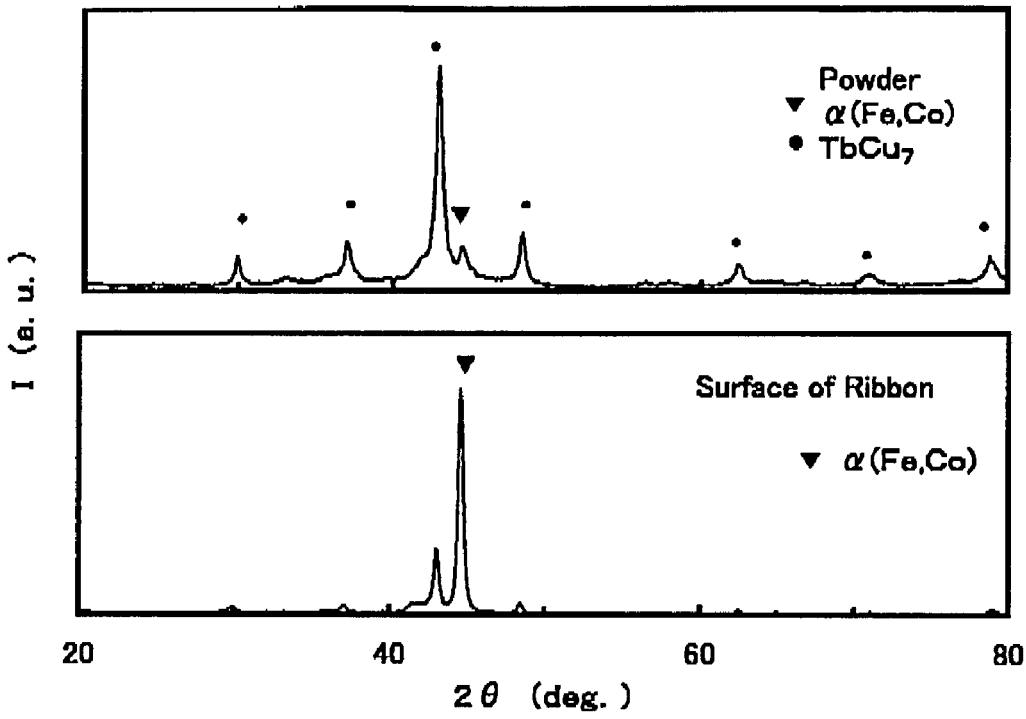
FIG. 4 is a graph illustrating X-ray diffraction patterns of the surface of a heat-treated thin alloy ribbon, and X-ray diffraction patterns of a powder sample.

The thin alloy ribbon having Hcj of 342.2 kA/m sampled from the heat-treated thin alloy ribbons were pulverized in a mortar to prepare a specimen for X-ray diffractometry. The results of X-ray diffraction (Cukα), as shown in the upper portion of FIG. 4, showed a diffraction peak attributable to α-(Fe, Co) in addition to the peaks assigned to the $TbCu_7$ phase. This is because that the Sm content was low as compared with that of Example 1 and the heat treatment temperature was higher than 640° C. as employed in Example 1, thereby allowing α-(Fe, Co) to precipitate during the heat treatment. Namely, Sm escaped by evaporation during the heat treatment to cause the formation of FeCo layer over entire portion from the surface of thin ribbon to a depth of 2 to 3 μm. In the lower portion of FIG. 4, an X-ray diffraction pattern of the heat-treated thin alloy strop having the FeCo layer is shown.

EXAMPLE 3

A hot melt prepared by melting an ingot of the same type as used in Example 2 was ejected onto a cooling roll (made of copper alloy) rotating at a peripheral speed (Vs) of 12 m/s or 8 m/s in a single roll liquid quenching apparatus to prepare quenched thin ribbons of 1 to 2 mm wide and 55 and 70 μm thick in average having a composition represented by the formula:

$$Sm_{5.8}Fe_{bal.}Co_{23.7}Zr_{2.0}Si_{0.43}B_{10.2}N_{0.002}.$$

Figure 5:
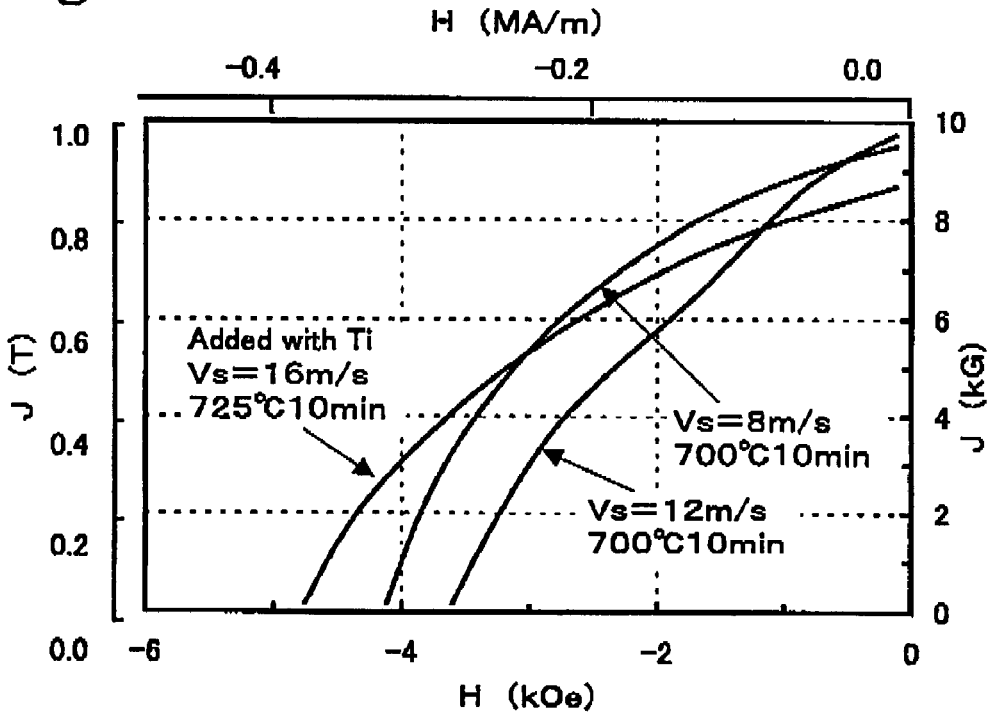
FIG. 5 is a graph showing one example of a demagnetization curve.

The resultant thin ribbons were heat-treated at 700° C. for 10 min in an argon gas atmosphere, and then, the magnetic properties at room temperature were measured in the same manner as in Example 1. As seen from FIG. 5, the heat-treated thin alloy ribbon (Vs=12 m/s) showed a demagnetization curve having knickpoints. On the other hand, in the demagnetization curve of the heat-treated thin alloy ribbon (Vs=8 m/s), knickpoints disappeared as shown in FIG. 5 to attain Hcj of 326.3 kA/m, Br of 0.95 T and (BH)max of 86.0 kJ/m$^3$. In the heat-treated thin alloy ribbons (Vs=8 m/s), a portion of B was consumed as a boride of Zr to prevent the precipitation of the soft magnetic phase during the heat treatment, thereby dissipating the knickpoints from the demagnetization curve.

Next, respective amounts of Sm, Fe, Co, Zr, Ti and B were melted to prepare an ingot. A hot melt prepared by melting the ingot was ejected by a single roll method onto a cooling roll (made of copper alloy) rotating at Vs=16 m/s to obtain quenched thin ribbons (average thickness: 43 μm) having a composition represented by the formula: $Sm_{6.0}Fe_{bal.}Co_{24.1}Zr_{2.0}Ti_{1.2}Si_{0.17}B_{10.2}N_{0.001}$. The resultant thin ribbons were heat-treated at 725° C. for 10 min, and the magnetic properties thereof at room temperature were measured in the same manner as in Example 1. As seen from FIG. 5, the thin alloy ribbon showed a demagnetization curve with no knickpoint and exhibited Hcj of 374.0 kA/m, Br of 0.88 T and (BH)max of 78.0 kJ/m$^3$. This result reflects the effect of preventing the precipitation of a soft magnetic phase during the heat treatment by the consumption of a portion of B to form a boride with the added Ti.

EXAMPLE 4

Figure 6:
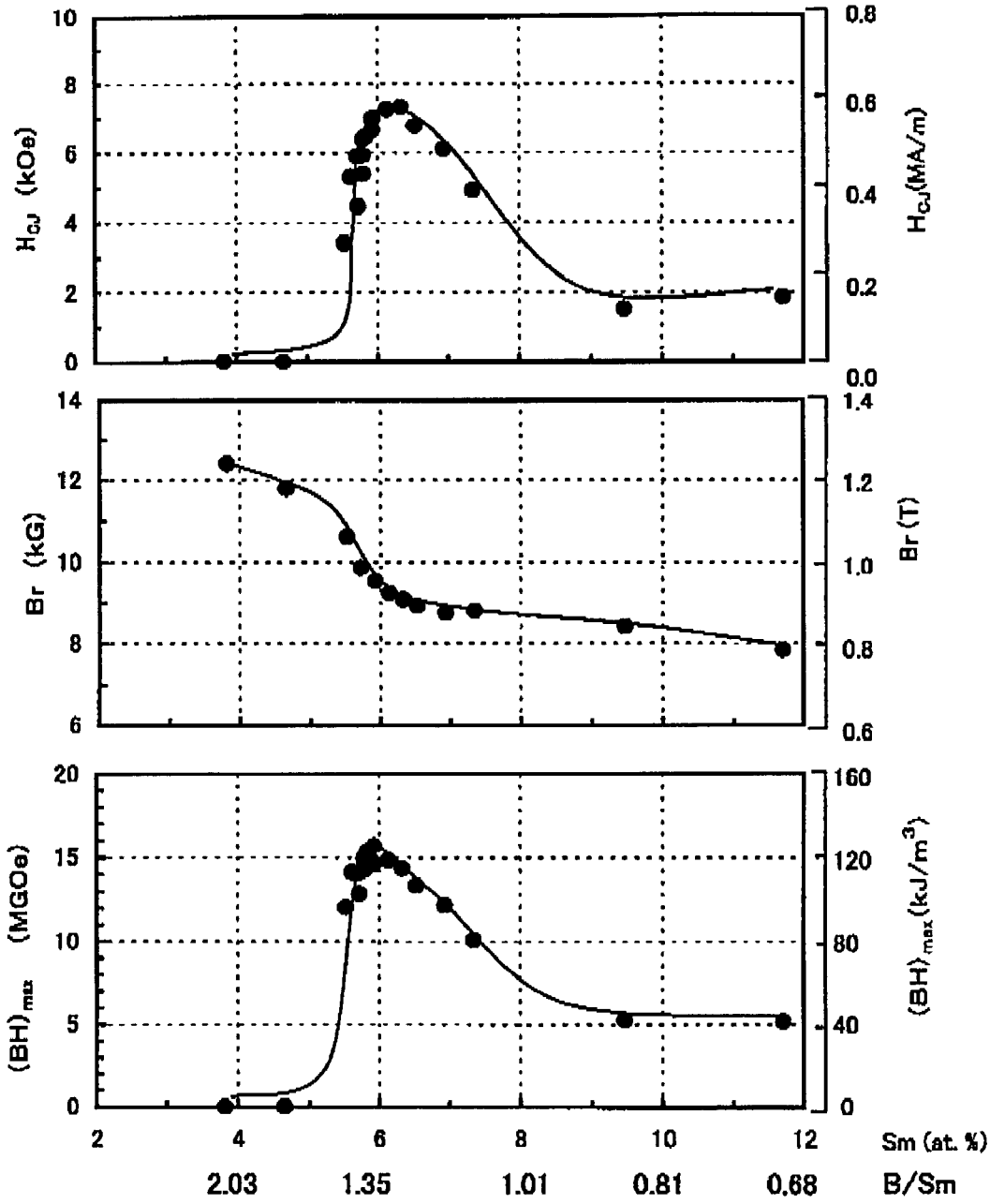
FIG. 6 is a graph showing one example of the relationship between the content of Sm, (B/Sm) and the magnetic properties.
Figure 7:
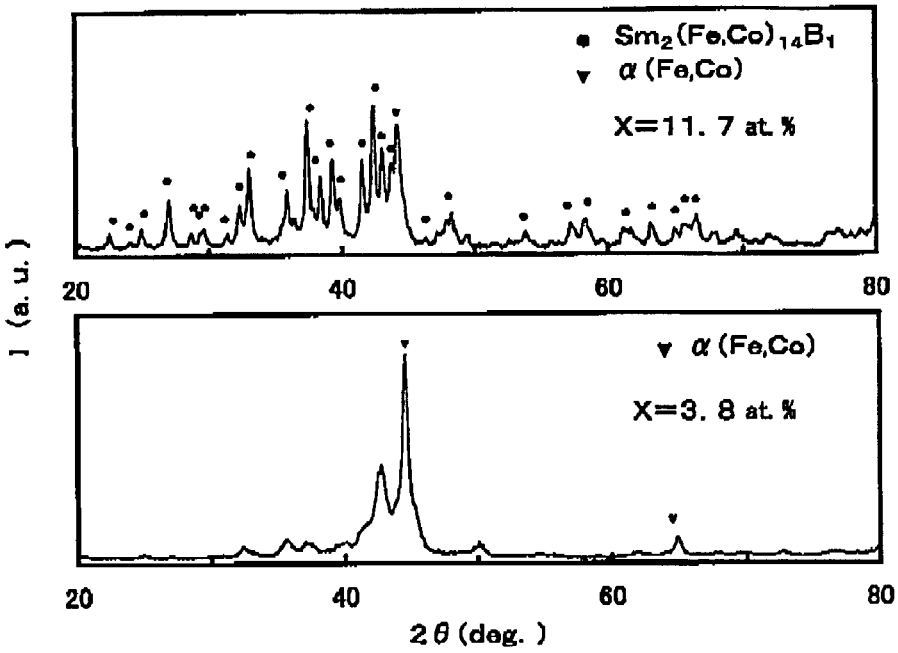
FIG. 7 is a graph illustrating X-ray diffraction patterns of a powder of a heat-treated thin alloy ribbon having a low Hcj.

The relationship between the Sm content and the magnetic properties was examined. Respective amounts of Sm, Fe, Co, Nb and B were arc-melted in a pressure-reduced argon atmosphere to prepare two kinds of ingots having different Sm contents. Each of mixtures of two kinds of ingots having different mixing ratios was placed in a quartz tube nozzle of a single roll liquid quenching apparatus. Then, following the procedures of Example 1, thin alloy ribbons with different Sm contents were prepared by quenching the hot melts on a cooling roll rotating at a peripheral speed of 18 m/s. The average thickness of the thin alloy ribbons was 33 to 48 μm and the composition thereof determined by ICP analysis was $Sm_xFe_{bal.}Co_{16.3}Nb_{2.7}Si_{0.15}B_{8.1}N_{0.001}$ (x=3.8 to 11.7). After heat-treating each thin alloy ribbon at 640° C. for 1.5 h in an argon atmosphere, the magnetic properties at room temperature were measured in the same manner as in Example 1. The results are shown in FIG. 6. Each heat-treated thin alloy ribbon wherein x is 3.8 or 11.7 at. % was pulverized in a mortar and analyzed by X-ray diffractometry (Cukα). The results are shown in FIG. 7.

As seen from FIG. 6, Hcj appeared in a Sm content range of 5 at. % or higher, and a high Hcj exceeding 397.9 kA/m was attained in a Sm content range of 5.5 to 7 at. %. In a Sm content range of lower than 5.5 at. %, Hcj was abruptly reduced to 238.7 to 318.3 kA/m, but Br increased to exceed 1.0 T. In a Sm content around 6 at. %, Hcj and Br were both high and (BH)max as high as 111.4 to 127.4 kJ/m$^3$ was achieved. It can be also seen that Hcj of 238.7 kA/m or more was achieved in a B/Sm range of 0.9 to 1.5. As seen from FIG. 7, the heat-treated thin alloy ribbon, wherein x was 11.7 at. %, exhibiting Hcj of about 159.2 kA/m was structured by $Sm_2(Fe,Co)_{14}B_1$ crystal. In the heat-treated thin alloy ribbon wherein x was 3.8, the precipitation of α-(Fe, Co) was considerable and the remaining phase differed from $TbCu_7$ crystal phase.

EXAMPLE 5

The relationship between the ratio of Sm occupying R and the magnetic properties was examined. From Sm, Pr, Fe, Co, Zr, B and Si, ingots were prepared while varying the ratio of Sm/Pr in R. Each piece of ingots was melted in a quartz tube nozzle by high-frequency heating, and the resultant hot melt was quenched by a single roll method (peripheral speed: 12 m/s; copper alloy roll) to prepare thin alloy ribbons. After heat-treating the thin alloy ribbons at 700° C. for 20 min in an argon gas atmosphere, the magnetic properties at room temperature were measured in the same manner as in Example 1. The obtained thin alloy ribbons were 37 to 51 μm thick in average and had a composition of $(Sm_{1-r}Pr_r)_{5.8}Fe_{bal.}Co_{24.8}Zr_{2.1}Si_{0.5}B_{8.5}N_{0.001}$ (r=0, 0.18, 0.35, 0.69, 1.0).

Next, from Sm, Gd, Dy, Fe, Co, Nb, B and Si, thin alloy ribbon specimens with a portion of Sm substituted by Gd or Dy were prepared, while changing the peripheral speed of cooling roll (copper alloy roll) to 16 m/s and the conditions of heat-treating the quenched thin ribbons in an argon gas atmosphere to 660° C. for 40 min (Dy-substituted specimen) or to 680° C. for 10 min (Gd-substituted specimen). The heat-treated thin alloy ribbons were 40 to 50 μm thick in average and had compositions nearly represented by the formula: $(Sm_{1-r}R_r)_{6.8}Fe_{bal.}Co_{12.2}Nb_{2.4}Si_{0.7}B_{8.2}N_{0.002}$ (r=0, 0.12, 0.23 or 0.35; R=Gd or Dy). After the heat treatment, the magnetic properties at room temperature were measured in the same manner as in Example 1.

In FIG. 8, the relationship of Hcj and the substitution ratio r of Pr, Gd or Dy for a portion of Sm. As seen from FIG. 8, Hcj uniformly decreased by the substitution of a portion of Sm with Pr, Gd or Dy. Hcj decreased by about 79.6 kA/m when the ratio r reached 0.2 to 0.3. At r=0.9 to 1.0, a practically applicable Hcj of 238.7 kA/m or higher was attained.

Next, the substitution of a portion of Sm with Y, La, Nd, Eu, Tb, Ho, Er, Tm, Yb or Lu was evaluated. In any cases, the substitution of Sm with another rare earth element decreased Hcj with increasing substitution ratio.

From the foregoing, it has been found that R is allowed to contain the rare earth element other than Sm up to 30 at. %, and the content is preferably limited to an inevitable extent.

EXAMPLE 6

The relationship between the Co content and the magnetic properties was examined. From Sm, Fe, Co, Nb, Zr, B and Si, the following three kinds of thin alloy ribbons (Nb-containing alloys and Zr-containing alloy) having different Co contents were prepared. The average thickness of the thin alloy ribbons was 37 to 62 μm.

(1) $Sm_{5.6}Fe_{bal.}Co_xZr_{2.1}B_{8.5}Si_{0.5}N_{0.001}$ (x=0 to 49)

(2) $Sm_{6.4}Fe_{bal.}Co_xNb_{2.7}B_{8.1}Si_{0.1}N_{0.002}$ (x=12 to 41)

(3) $Sm_{6.4}Fe_{bal.}Co_xNb_{2.7}B_{8.1}Si_{0.5}N_{0.001}$ (x=0 to 8)

The obtained thin alloy ribbons were quenched at the following peripheral speed of cooling roll (copper alloy roll) and then heat-treated in an argon gas atmosphere under the following conditions: 12 m/s and at 700° C. for 20 min for the ribbon (1) except for heat-treating at 600° C. for 60 min when x is zero; 18 m/s and at 640° C. for 90 min for the ribbon (2); and 18 m/s and at 680° C. for 10 min for the ribbon (3). The heat-treated thin alloy ribbons were measured on their magnetic properties at room temperature in the same manner as in Example 1. The results are shown in FIG. 9.

Figure 9:
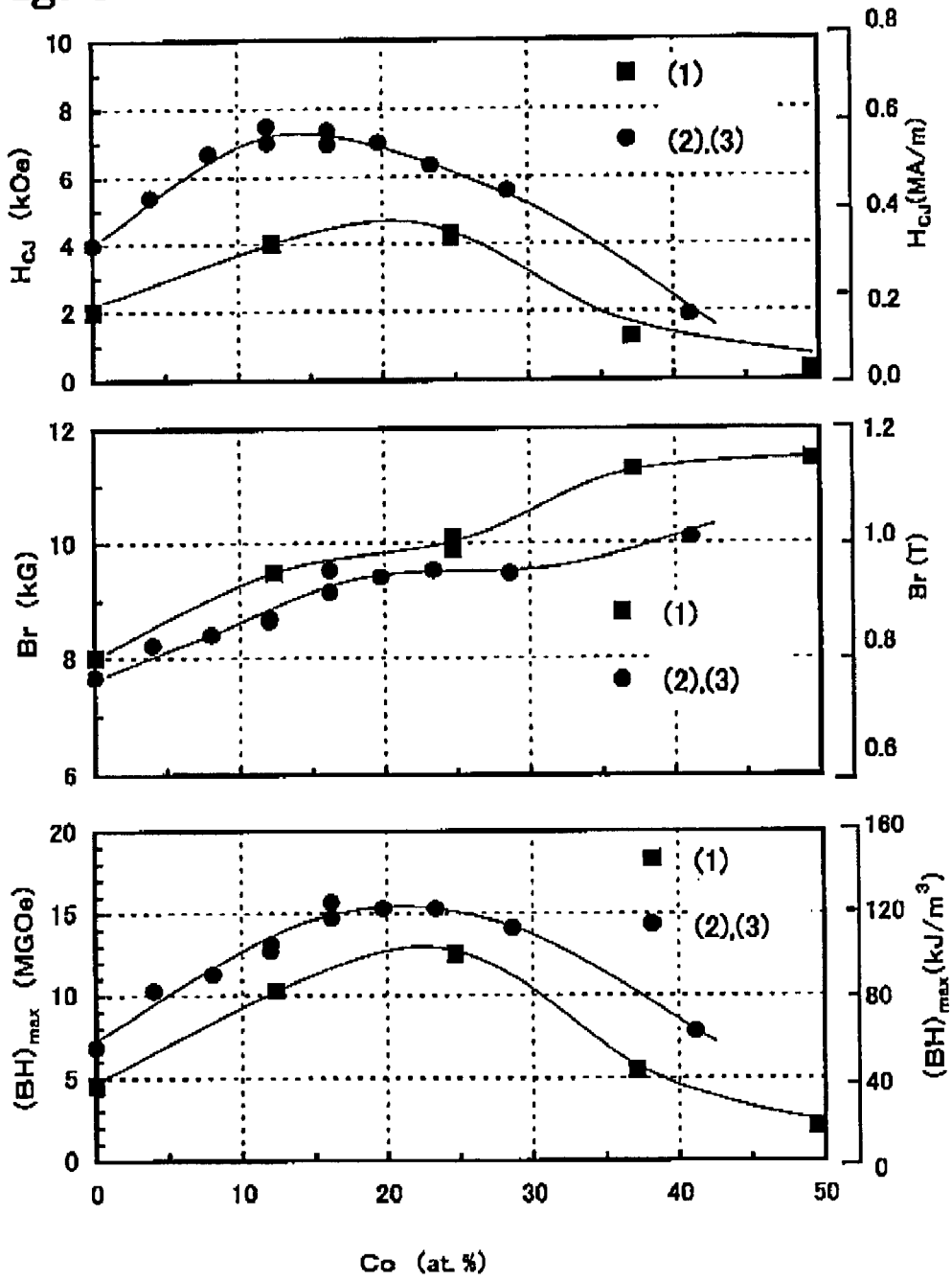
FIG. 9 is a graph showing one example of the relationship between the content of Co and the magnetic properties.

FIG. 9 shows that Hcj, Br and (BH)max were increased when a limited amount of Co was contained. Particularly in the compositions (2) and (3) with Nb and Co being combinedly added, Hcj as high as 477.5 kA/m and Br as high as 0.8 to 0.95 T were attained in a Co content range of 5 to 25 at. %, and (BH)max reaching as high as 120 kJ/m$^3$ was attained in a Co content range of 16to 24at. %.

In a Co content range exceeding 30 at. %, Br was high but Hcj was drastically lowered, resulting in a significant decrease of (BH)max. It was found that Hcj was lower than 238.7 kA/m in a Co content range of higher than 30 at. % for the composition (1), and lower than 238.7 kA/m in a Co content range of 35 to 38 at. % for the composition (2).

EXAMPLE 7

The relationship between the content of M element and the magnetic properties was examined. The evaluation was made on each thin alloy ribbon containing each amount of Sm, Fe, Co, B, Si and M element (M was at least one element selected from the group consisting of Nb, Ti, Zr, Hf, V, Mo, Cr and Mn). Specifically, the liquid quenching, the heat treatment and the measurement of the magnetic properties at room temperature of the thin alloy ribbons were conducted in the same manner as in Example 1 except for using the thin alloy ribbons of the compositions Nos. 1 to 16 and employing the peripheral speeds of cooling roll and the heat treatment conditions as shown in Table 1. In addition, a thin alloy ribbon containing no M element (composition No. 17 in Table 1) was prepared and measured on its magnetic properties at room temperature in the same manner as in Example 1 except for using the peripheral speed of cooling roll and the heat treatment conditions as shown in Table 1. The results of the measurements of the magnetic properties are shown in Table 1.

TABLE 1

| No | Compositions of thin alloy ribbons | Peripheral speed of roll (m/s) | Heat treatment conditions | Hcj (kOe) (kA/m) | Br (kG) (T) | (BH)max (MGOe) (kJ/m$^3$) |
|---|---|---|---|---|---|---|
| 1 | $Sm_{6.5}Fe_{bal.}Co_{12.1}$ | 16 | 680° C. | 6.6 | 8.7 | 12.7 |
| | $Nb_{2.5}B_{8.4}Si_{0.7}N_{0.001}$ | | 10 min | 525.2 | 0.87 | 101.1 |
| 2 | $Sm_{6.5}Fe_{bal.}Co_{12.1}$ | 16 | 660° C. | 5.4 | 9.1 | 12.8 |
| | $Ti_{2.5}B_{8.4}Si_{0.7}N_{0.001}$ | | 10 min | 429.7 | 0.91 | 101.9 |
| 3 | $Sm_{6.5}Fe_{bal.}Co_{12.1}$ | 16 | 640° C. | 5.0 | 8.6 | 10.9 |
| | $V_{2.5}B_{8.4}Si_{0.7}N_{0.002}$ | | 10 min | 397.9 | 0.86 | 86.8 |
| 4 | $Sm_{6.5}Fe_{bal.}Co_{12.1}$ | 16 | 700° C. | 3.6 | 8.4 | 9.7 |
| | $Zr_{2.5}B_{8.4}Si_{0.7}N_{0.001}$ | | 10 min | 286.5 | 0.84 | 77.2 |
| 5 | $Sm_{6.5}Fe_{bal.}Co_{12.1}$ | 16 | 680° C. | 4.1 | 8.2 | 10.2 |
| | $Hf_{2.5}B_{8.4}Si_{0.7}N_{0.001}$ | | 10 min | 326.3 | 0.82 | 81.2 |
| 6 | $Sm_{6.5}Fe_{bal.}Co_{12.1}$ | 16 | 680° C. | 5.3 | 8.0 | 10.3 |
| | $Mo_{2.5}B_{8.4}Si_{0.7}N_{0.001}$ | | 10 min | 421.8 | 0.8 | 82.0 |
| 7 | $Sm_{5.9}Fe_{bal.}Co_{20.7}$ | 12 | 700° C. | 5.2 | 8.9 | 11.8 |
| | $Zr_{2.0}V_{4.4}B_{8.8}Si_{0.1}$ | | 20 min | 413.8 | 0.89 | 93.9 |
| 8 | $Sm_{5.9}Fe_{bal.}Co_{20.7}$ | 12 | 700° C. | 4.3 | 8.6 | 10.4 |
| | $Zr_{2.0}Cr_{44}B_{8.8}Si_{0.1}N_{0.001}$ | | 20 min | 342.2 | 0.86 | 82.8 |
| 9 | $Sm_{5.9}Fe_{bal.}Co_{20.7}$ | 12 | 700° C. | 3.8 | 8.9 | 9.5 |
| | $Zr_{2.0}Mn_{4.4}B_{8.8}Si_{0.1}N_{0.001}$ | | 20 min | 302.4 | 0.89 | 75.6 |
| 10 | $Sm_{5.9}Fe_{bal.}Co_{20.7}$ | 12 | 700° C. | 3.9 | 9.4 | 11.4 |
| | $Zr_{2.0}Nb_{4.4}B_{8.8}Si_{0.1}N_{0.001}$ | | 20 min | 310.4 | 0.94 | 90.7 |
| 11 | $Sm_{6.2}Fe_{bal.}Co_{10.9}Zr_{2.2}$ | 12 | 700° C. | 5.2 | 8.2 | 10.4 |
| | $V_{1.1}Ti_{1.1}B_{9.2}Si_{0.2}N_{0.001}$ | | 20 min | 413.8 | 0.82 | 82.8 |
| 12 | $Sm_{6.2}Fe_{bal.}Co_{8.9}Zr_{2.0}V_{1.0}$ | 12 | 700° C. | 5.3 | 8.3 | 10.6 |
| | $Nb_{1.0}B_{7.2}Si_{0.2}N_{0.002}$ | | 20 min | 421.8 | 0.83 | 84.4 |
| 13 | $Sm_{6.4}Fe_{bal.}Co_{12.0}$ | 16 | 640° C. | 7.7 | 8.2 | 11.9 |
| | $Nb_{1.6}Mo_{0.8}B_{8.1}Si_{0.7}N_{0.001}$ | | 180 min | 612.8 | 0.82 | 94.7 |
| 14 | $Sm_{6.4}Fe_{bal.}Co_{12.0}$ | 16 | 640° C. | 6.7 | 8.8 | 12.6 |
| | $Nb_{1.6}V_{0.8}B_{8.1}Si_{0.7}N_{0.001}$ | | 180 min | 533.2 | 0.88 | 100.3 |
| 15 | $Sm_{6.4}Fe_{bal.}Co_{12.0}$ | 16 | 640° C. | 7.2 | 8.5 | 12.4 |
| | $Nb_{1.6}Ti_{0.8}B_{8.1}Si_{0.7}N_{0.001}$ | | 180 min | 573.0 | 0.85 | 98.7 |
| 16 | $Sm_{5.9}Fe_{bal.}Co_{12.2}$ | 16 | 640° C. | 6.7 | 8.5 | 11.9 |
| | $Nb_{24}Zr_{0.8}B_{8.2}Si_{0.7}N_{0.001}$ | | 180 min | 533.2 | 0.85 | 94.7 |
| 17 | $Sm_{7.5}Fe_{bal.}Co_{12.3}$ | 16 | 625° C. | 3.6 | 9.6 | 9.4 |
| | $B_{8.2}Si_{0.5}N_{0.001}$ | | 10 min | 286.5 | 0.96 | 74.8 |

As seen from Table 1, No. 17 containing no M element showed Hcj of 286.5 kA/m and Br of 0.96 T, but the squareness of the demagnetization curve slightly poor to show (BH)max of 74.8 kJ/m$^3$. Nos. 1 to 16 containing M element in prescribed amounts showed improvement in Hcj and (BH)max. Upon comparing Nos. 1 to 6, No. 1 containing Nb as M element showed the highest Hcj. Upon comparing Nos. 7 to 10, No. 7 combinedly added with Zr and V showed Hcj exceeding 397.9 kA/m. Nos. 11 and 12 showed that the combined addition of Zr+V+Ti, or Zr+V+Nb provided Hcj exceeding 397.9 ka/m. Nos. 13 to 16 showed that Hcj exceeding 477.5 kA/m was attained by the combined addition of Nb+Mo, Nb+V, Nb+Ti, or Nb+Zr.

EXAMPLE 8

The relationship between the contents of Si and Al and the magnetic properties was examined.

Thin alloy ribbons (average thickness: 43 and 48 μm) having the following composition were prepared in the same manner as in Example 1 except for liquid quenching at a roll peripheral speed of 16 m/s and heat-treating at 680° C. for 10 min in an argon atmosphere. The magnetic properties of the thin alloy ribbons were measured in the same manner as in Example 1.

$$Sm_{6.5}Fe_{bal.}Nb_{2.7}B_{8.2}Si_vN_{0.001}\ (v=0.1 \text{ or } 0.9)$$

Figure 10:
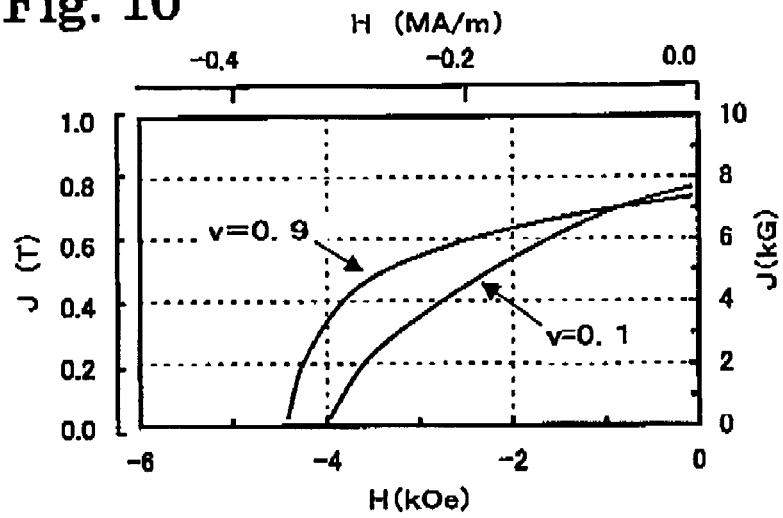
FIG. 10 is a graph showing another example of a demagnetization curve.

The demagnetization curves of the thin alloy ribbons are shown in FIG. 10. The squareness of the demagnetization curve was improved when the Si content was relatively large, i.e., v was 0.9.

Figure 11:
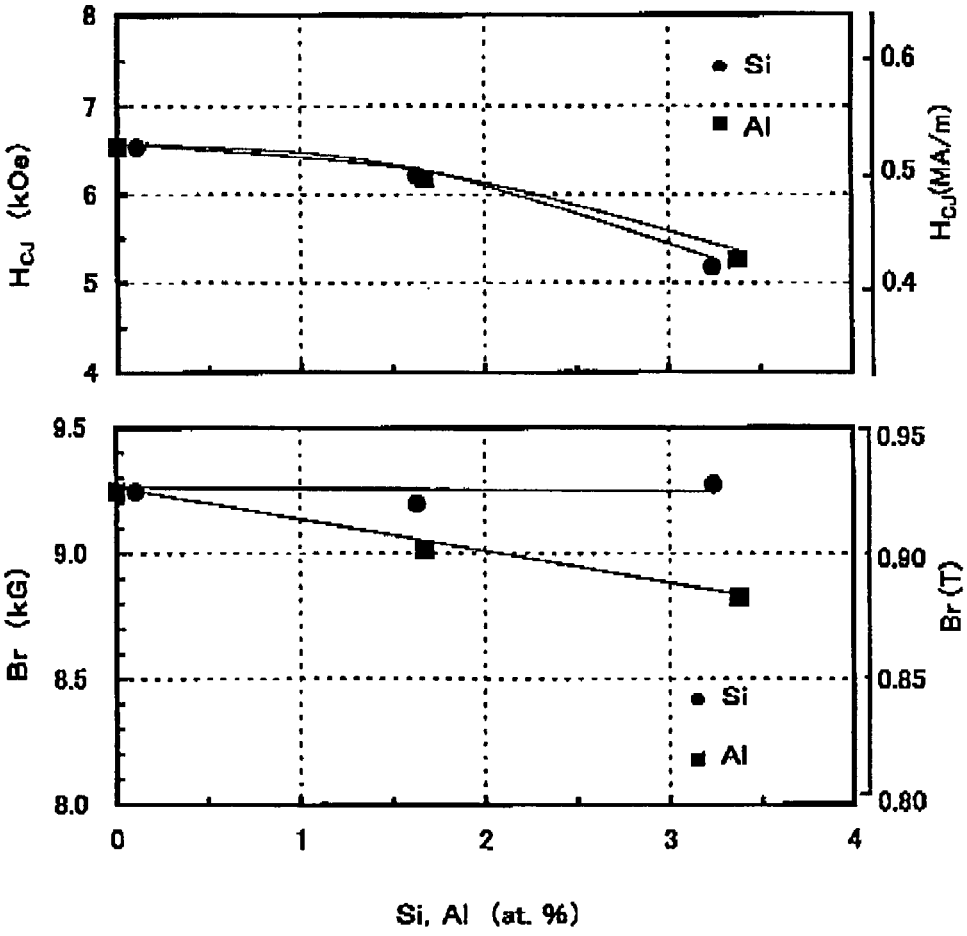
FIG. 11 is a graph showing one example of the relationship between the contents of Si and Al and the magnetic properties.

Next, thin alloy ribbons (average thickness: 43 to 55 μm) having a composition of $Sm_{6.4}Fe_{bal.}Co_{12.2}Nb_{2.7}B_{8.2}A_vN_{0.001}$ (A=Si or Al, v=0 to 3) were prepared in the same manner as in Example 1 except for liquid quenching at a roll peripheral speed of 16 m/s and heat-treating at 640° C. for 1.5 h in an argon gas atmosphere. Then, the magnetic properties of the thin alloy ribbons were measured in the same manner as in Example 1. The results of the measurements are shown in FIG. 11, from which it was found that the content of Si or Al should be limited to 2 at. % or less (exclusive of zero) because a content of Si or Al exceeding 2 at. % reduced Hcj significantly. In addition, Br was reduced significantly by increasing the Al content.

EXAMPLE 9

The relationship between the heat treatment conditions and the magnetic properties was examined.

Thin alloy ribbons (average thickness: 46 μm) having a composition of $Sm_{6.4}Fe_{bal.}Co_{12.4}Nb_{2.7}B_{8.1}Si_{0.5}N_{0.001}$ were prepared in the same manner as in Example 1 except for liquid quenching at a roll peripheral speed of 16 m/s. The quenched thin ribbons were heat-treated in an argon atmosphere at respective heat treatment temperatures of 620° C., 640° C., 660° C. and 680° C. while varying the heat treatment time. The magnetic properties of the heat-treated thin alloy ribbons were measured in the same manner as in Example 1 The relationship of Hcj of the thin alloy ribbons to the heat treatment time and temperature is shown in FIG. 12.

Figure 12:
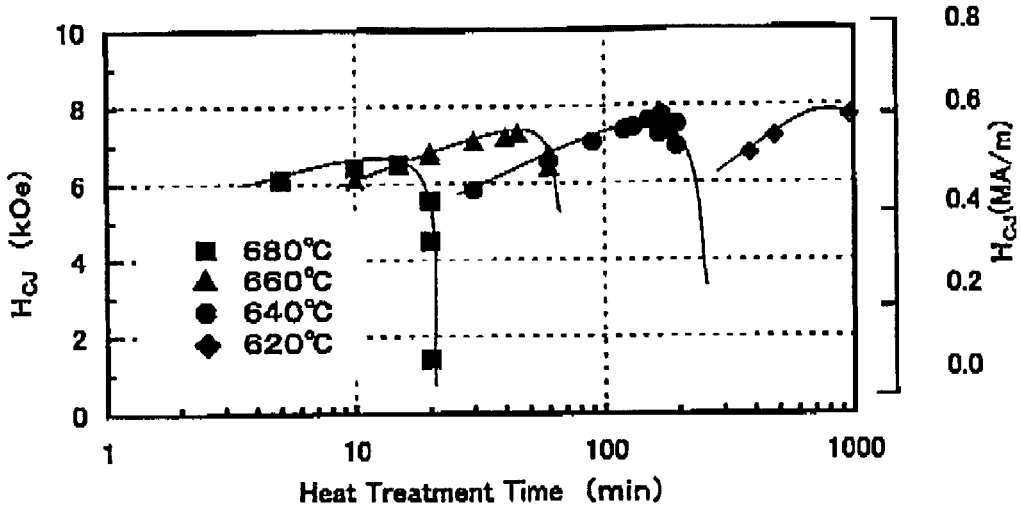
FIG. 12 is a graph showing one example of the relationship between the heat treatment conditions and Hcj.

FIG. 12 showed that Hcj was increased by the heat treatment at low temperature for a prolonged period of time. For example, the heat treatment at 680° C. for 10 min provided the maximum Hcj of 517.3 kA/m, whereas Hcj of 596.9 kA/m was attained by the heat treatment at 640° C. for 150 min. In each heat treatment temperature, Hcj was steeply decreased by a prolonged heat treatment beyond the optimum heat treatment time. Although not seen easily because the abscissa for the heat treatment time was log-scaled in FIG. 12, the change of Hcj with the heat treatment time was far more gentle for the heat treatment at 640° C. as compared with the heat treatment at 680° C.

Figure 13:
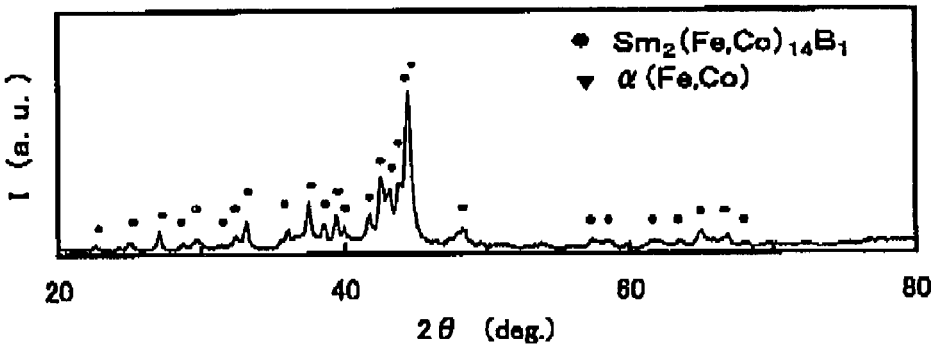
FIG. 13 is a graph showing X-ray diffraction patterns of a powder of a thin alloy ribbon heat-treated under inappropriate conditions.

Next, the quenched thin ribbons were heat-treated at 680° C. for one hour to prepare thin alloy ribbons of substantially soft magnetic nature, which were made into powder for X-ray diffraction analysis (Cukα). The results of X-ray diffraction are shown in FIG. 13. As seen from FIG. 13, the main phase, $TbCu_7$ crystal, was changed to $R_2(Fe, Co)_{14}B_1$, crystal and α-(Fe, Co) crystal by the heat treatment at 680° C. for one hour. This phenomenon was observed in both the heat treatments where heat-treated for a prolonged time beyond the heat treatment time optimum for the employed heat treatment temperature and where heat-treated at a higher temperature exceeding the heat treatment temperature optimum for the employed heat treatment time.

EXAMPLE 10

Temperature Coefficient α, β and Curie Temperature Tc

Thin alloy ribbons (average thickness: about 46 μm) having a composition of $Sm_{6.2}Fe_{bal.}Co_xNb_{2.7}Si_{0.7}B8.3N_{0.001}$ (x=0 to 12) were prepared in the same manner as in Example 1 except for heat treating the quenched thin ribbons at 680° C. for 10 min in an argon atmosphere. Using the heat-treated thin alloy ribbons, the temperature coefficient α of Br, the temperature coefficient β of Hcj and the Curie temperature Tc were measured by VSM. The temperature coefficients α and β mean the rates of change per one degree when the temperature is raised from 25° C. to 100° C., and defined by the following formulas.

$$\alpha = \frac{Br(100^\circ\ C.) - Br(25^\circ\ C.)}{Br(25^\circ\ C.) \times (100 - 25)} \times 100\ (\%/^\circ\ C.)$$

$$\beta = \frac{Hcj(100^\circ\ C.) - Hcj(25^\circ\ C.)}{Hcj(25^\circ\ C.) \times (100 - 25)} \times 100\ (\%/^\circ\ C.)$$

Figure 14:
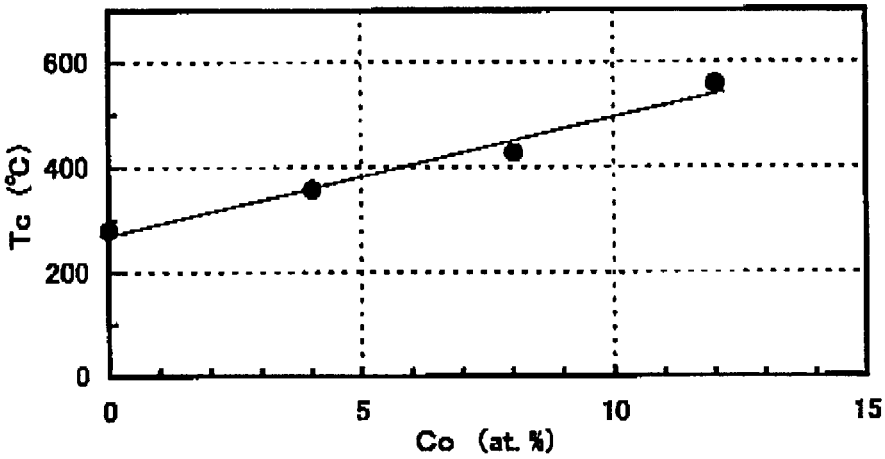
FIG. 14 is a graph showing one example of the relationship between the content of Co and Curie temperature.
Figure 15:
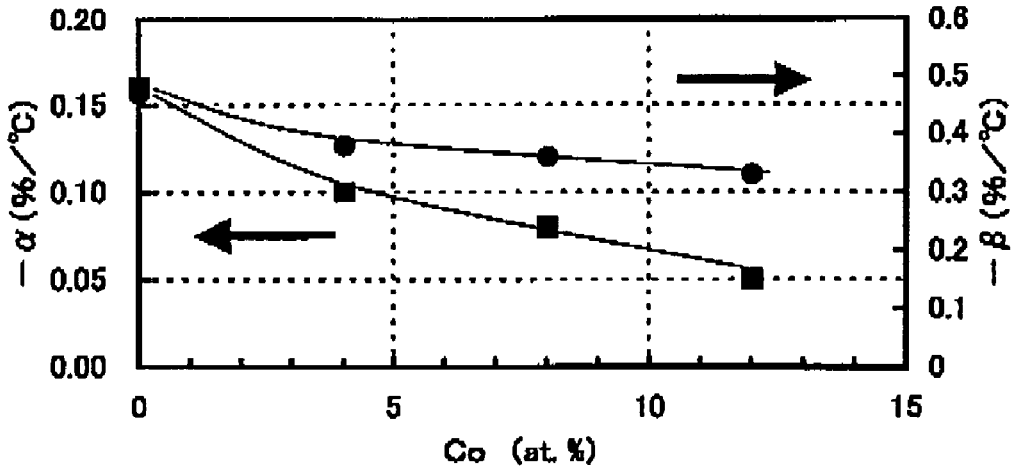
FIG. 15 is a graph showing one example of the relationship between the content of Co and the temperature coefficients α and β.

The relationship between the Co content of the heat-treated thin alloy ribbons with Tc is shown in FIG. 14. The relationship between the Co content of the thin alloy ribbons with α and β is shown in FIG. 15. As seen from FIG. 14, Tc almost linearly increased with increasing Co content, and reached a value as high as about 500° C. in the Co content range of 10 at. % or more. As seen from FIG. 15, α and β were improved with increasing Co content. Improved results, α=−0.05% /° C. and β=−0.33%/° C., were obtained at a Co content of 12 at. %. In this connection, the temperature coefficients at a Co content exceeding 4 at. % are lower than those (α=−0.12%/° C., β=−0.4%/° C.) of Nd—Fe—B powder for bonded magnets (trade name: MQP-B manufactured by Magnequench Co., Ltd.), this showing the excellent temperature properties of the permanent magnetic alloy of the present invention.

EXAMPLE 11

The relationship between the cooling roll peripheral speed in the liquid quenching method (single roll method), the average thickness of thin alloy ribbons and the magnetic properties was examined.

Thin alloy ribbons having a composition of $Sm6.2Fe_{bal.}Co_{16.4}Nb_{2.7}B_{8.1}Si_{0.15}N_{0.001}$ were prepared in the same manner as in Example 1 except for using the alloy composition as shown above, and changing the cooling roll peripheral speed (Vs) to 4 to 41 m/s and the heat treatment conditions in an argon gas atmosphere to 640° C. for 90 min. The magnetic properties were measured in the same manner as in Example 1. The average thickness of the thin alloy ribbons was measured by a micrometer to examine the relationship between Vs, the average thickness and the magnetic properties. The results thereof are shown in FIGS. 16 and 17.

Figure 16:
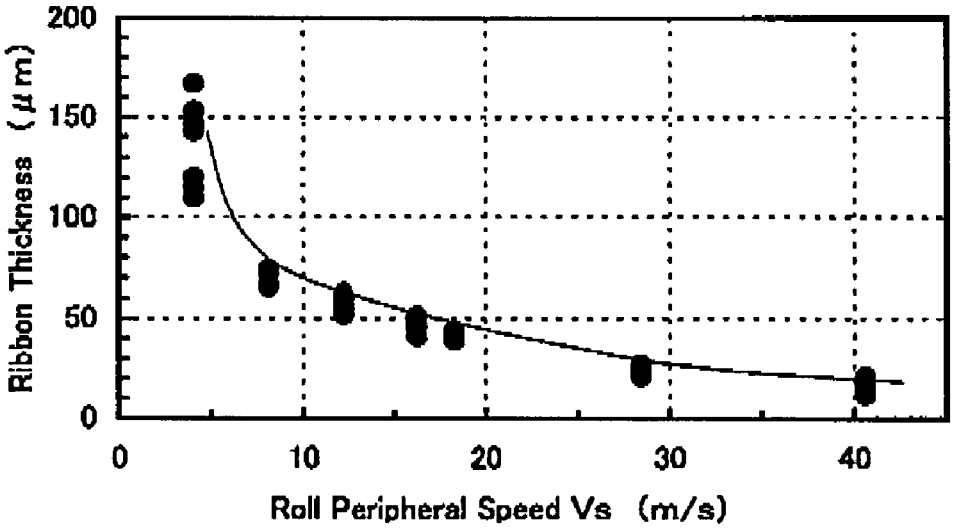
FIG. 16 is a graph showing one example of the relationship between the peripheral speed of a cooling roll and the average thickness of a thin alloy ribbon.

As seen from FIG. 16, the average thickness of the quenched thin ribbons prepared at a roll peripheral speed of 12 to 18 m/s was about 40 to 60 μm. This range of the average thickness is about 2 to 3 times the average thickness of quenched thin ribbons for conventional Sm—Fe—N magnets. In the production of quenched thin ribbons for Sm—Fe—N magnets by a single roll method, the quenching is preferably conducted at an extremely high roll peripheral speed of 40 to 75 m/s to obtain thin ribbons as thin as possible. This is because that thin alloy ribbons with a thinner thickness are advantageous for the subsequent nitridation treatment, being in contrast to the present invention wherein a fairly large thickness is preferred.

Figure 17:
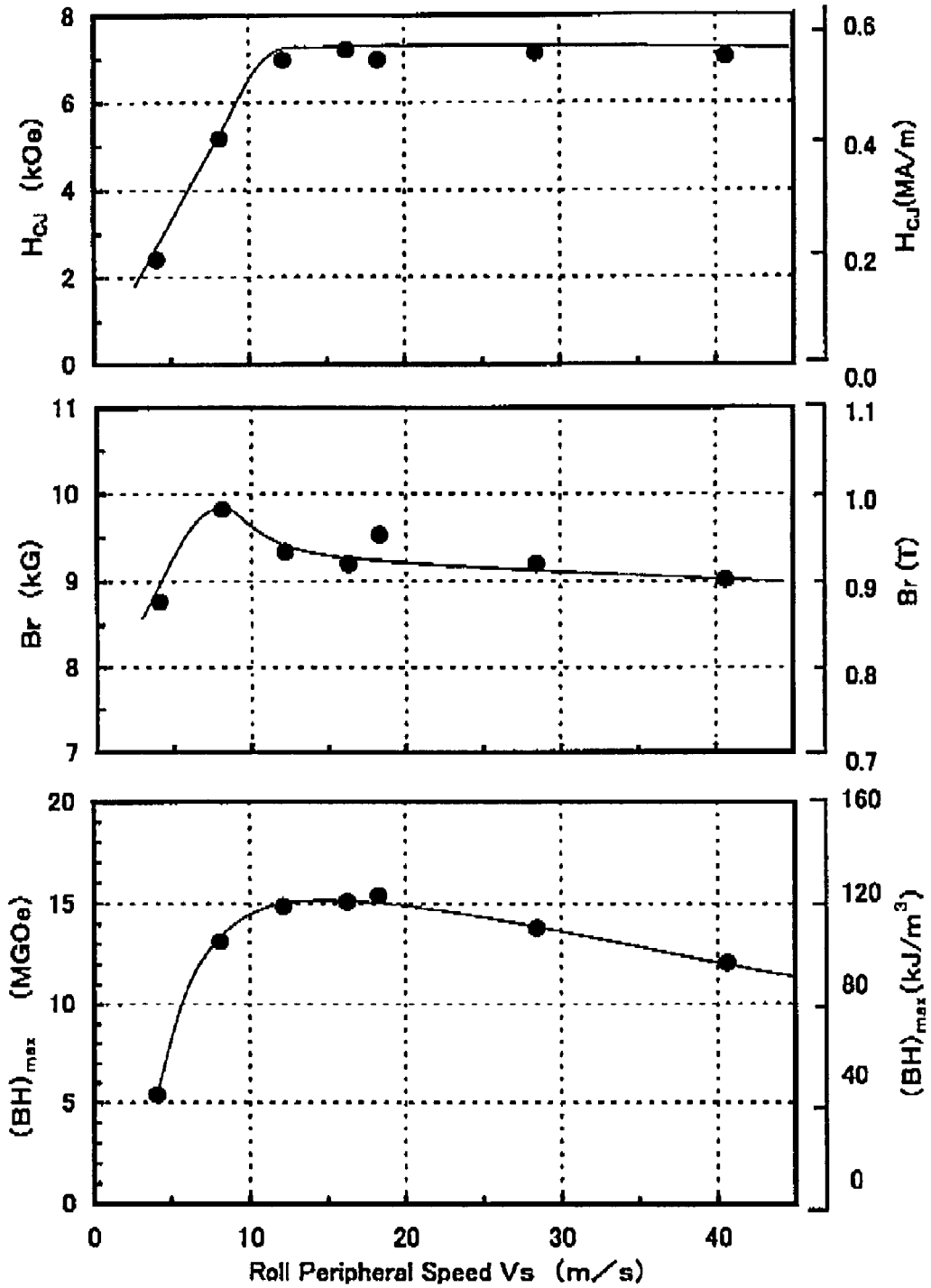
FIG. 17 is a graph showing one example of the relationship between the peripheral speed of a cooling roll and the magnetic properties of a heat-treated thin alloy ribbon.

As seen from FIG. 17, high Br and (BH)max were obtained at a roll peripheral speed of 8 to 30 m/s. However, (BH)max tended to gradually decrease when the roll peripheral speed exceeded 20 m/s. This is because that the influence of the Fe-rich soft magnetic surface layer formed during the heat treatment becomes non-negligible when the thickness of thin alloy ribbons are decreased, thereby reducing the squareness of the demagnetization curve. The main cause for the drastic reduction of the magnetic properties at a roll peripheral speed of 4 m/s is the precipitation of $Sm_2(Fe, Co)_{14}B_1$ and α-(Fe, Co).

EXAMPLE 12

Ingots and thin alloy ribbons (average thickness: 48 μm) having a composition of $Sm_{6.4}Fe_{bal.}Co12.6Nb_{2.7}B_{8.3}Si_{0.15}N_{0.001}$ were prepared in the same manner as in Example 1 except for heat-treating at 640° C. for 160 min in an argon atmosphere. X-ray diffraction (Cukα) patterns of the ingot, the quenched thin alloy ribbon, and the heat-treated thin alloy ribbon are shown in FIG. 18.

Figure 18:
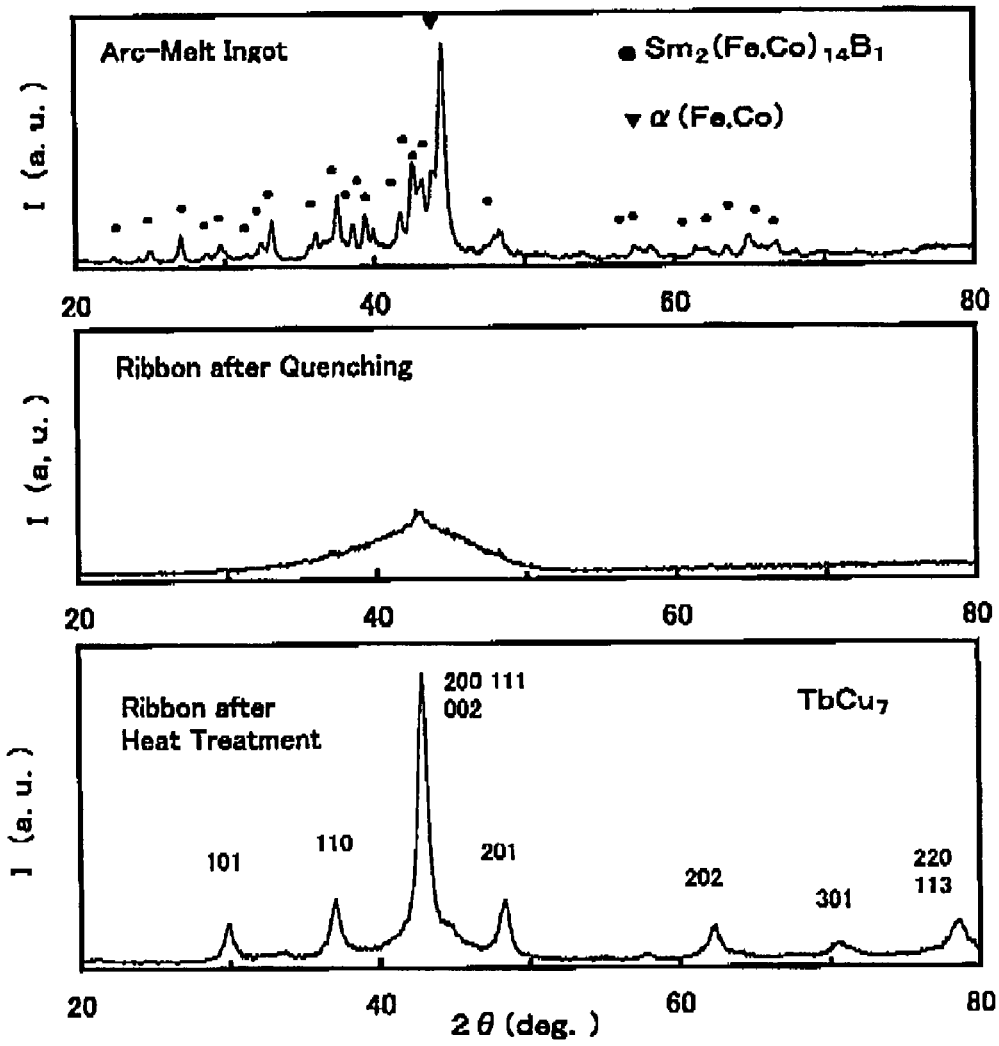
FIG. 18 is a graph illustrating X-ray diffraction patterns of an ingot, a thin alloy ribbon after quenching, or a thin alloy ribbon after heat treatment.

As seen from FIG. 18, the ingot was constructed by $Sm_2(Fe, Co)_{14}B_1$ phase and α-(Fe, Co) phase. The heat-treated thin alloy ribbon showed diffraction peaks attributable to $TbCu_7$ crystal. The quenched thin ribbon was not completely amorphous, and its diffraction pattern overlapping the halo peaks of the amorphous phase had small peaks at a diffraction angle 2θ of 42 to 43°, showing the precipitation of a trace amount of crystal phase.

EXAMPLE 13

The quenched thin ribbons of the same type as used in Example 12 were heat-treated in an argon gas atmosphere under respective conditions at 640° C. for 10 min and at 640° C. for 160 min to prepare thin alloy ribbons. The quenched thin alloy ribbons and the heat-treated thin alloy ribbons were observed under TEM using a field emission transmission electron microscope (FE-2100 Model manufactured by Hitachi, Ltd.).

Figure 19:
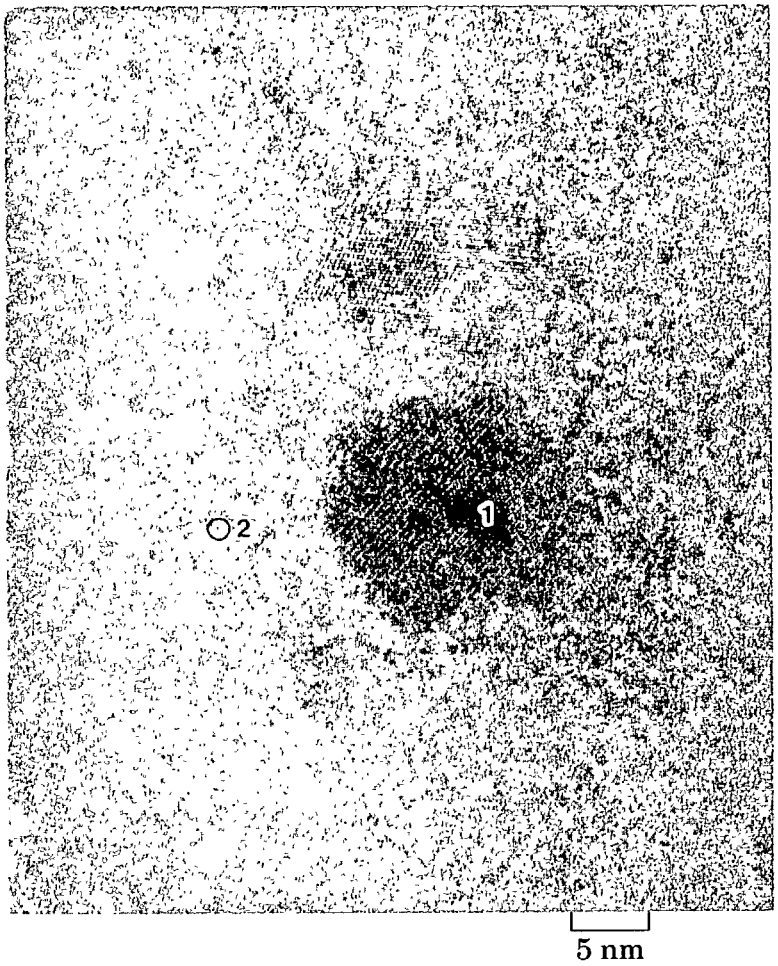
FIG. 19 is a TEM photograph showing the metal structure of a cross section of a thin alloy ribbon after quenching.
Figure 20:
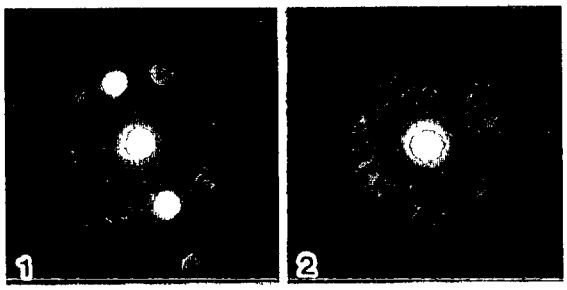
FIG. 20 illustrates nano electron diffraction patterns corresponding to the positions 1 and 2 of FIG. 19.
Figure 21:
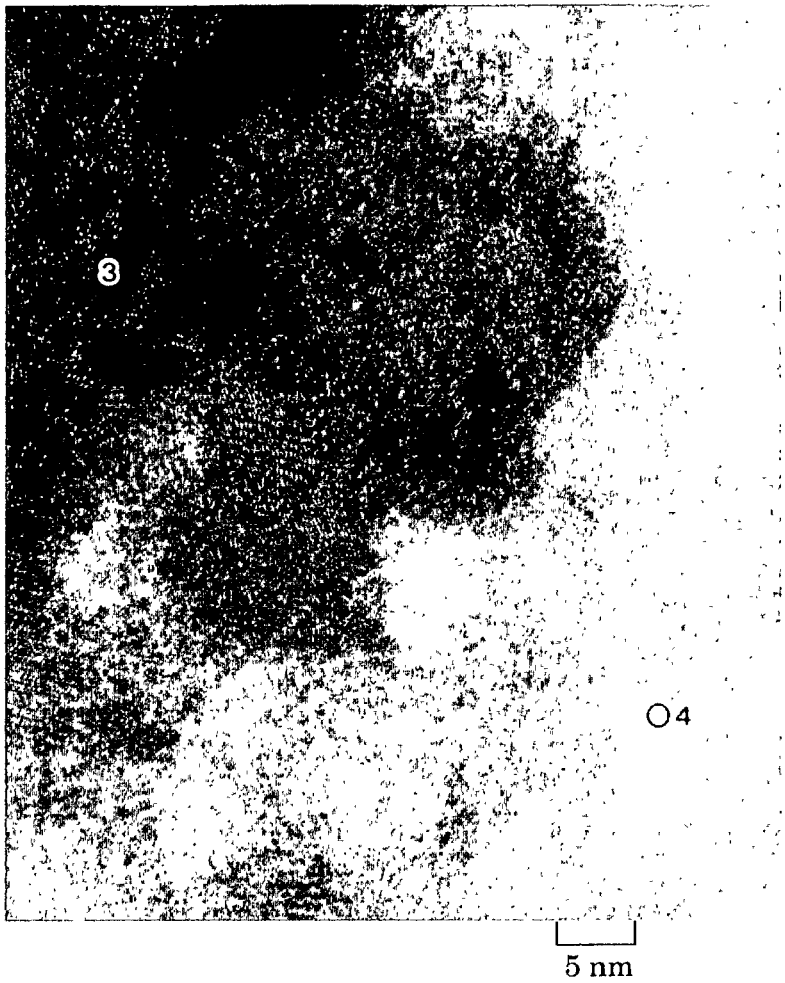
FIG. 21 is a TEM photograph showing one example of the metal structure of a cross section of a thin alloy ribbon after heat treatment.
Figure 22:
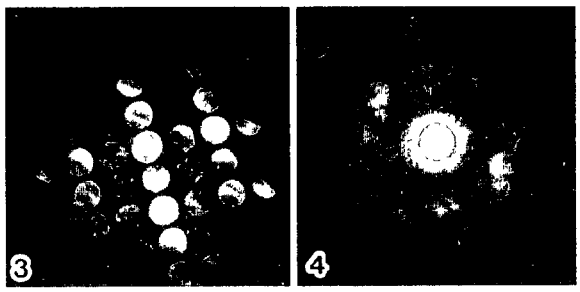
FIG. 22 illustrates nano electron diffraction patterns corresponding to the positions 3 and 4 of FIG. 21.
Figure 23:
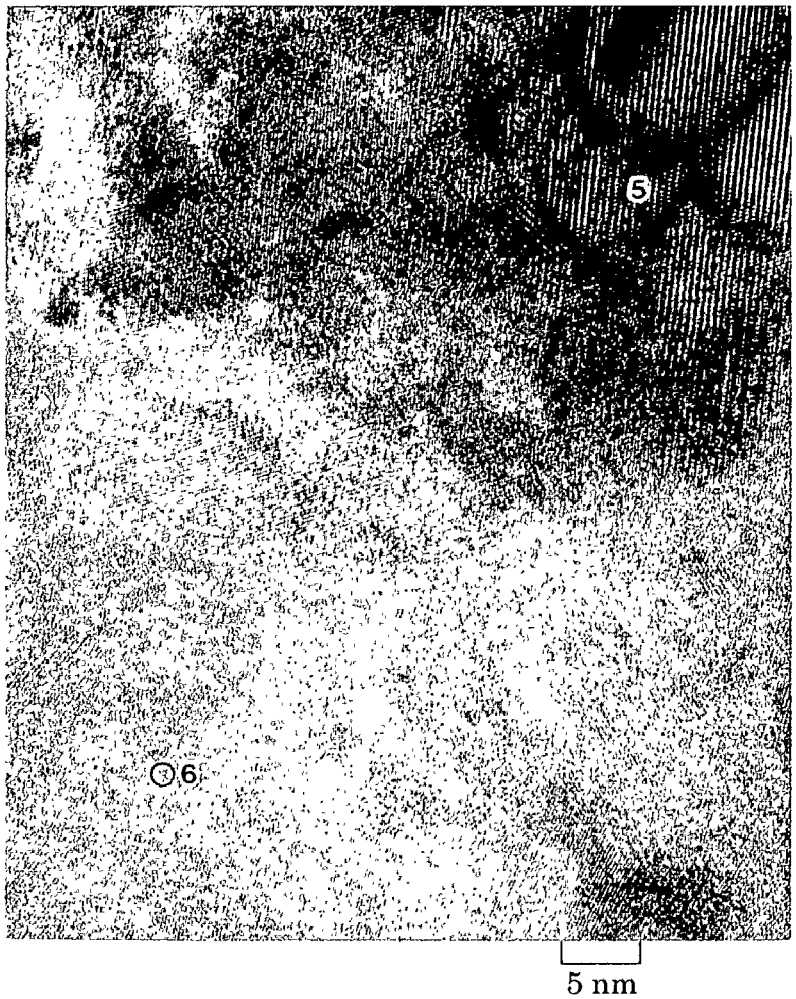
FIG. 23 is a TEM photograph showing the metal structure of a cross section of another thin alloy ribbon after heat treatment.
Figure 24:
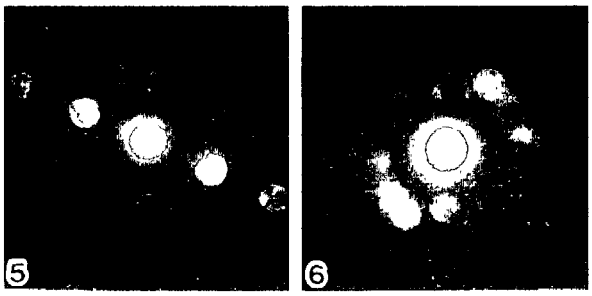
FIG. 24 illustrates nano electron diffraction patterns corresponding to the positions 5 and 6 of FIG. 23.

TEM photograph of the quenched thin ribbon is shown in FIG. 19. TEM photograph of the thin alloy ribbon after heat-treated at 640° C. for 10 min is shown in FIG. 21. TEM photograph of the thin alloy ribbon after heat-treated at 640° C. for 160 min is shown in FIG. 23. The results of nano electron diffraction on the positions 1 and 2 of FIG. 19 are shown in FIG. 20. The results of nano electron diffraction on the positions 3 and 4 of FIG. 21 are shown in FIG. 22. The results of nano electron diffraction on the positions 5 and 6 of FIG. 23 are shown in FIG. 24. The nano electron diffraction was carried out by the irradiation of the measuring fields with electron beam having a spot diameter of 2 nm.

As seen from FIGS. 19 and 20, the quenched thin ribbon was nearly amorphous (position 2), and the fine crystals (position 1) having a diameter of about 20 nm were scattered therein. These results agree with the X-ray diffraction analysis of Example 12.

As seen from FIGS. 21 and 22, $TbCu_7$ crystal (position 3) having a diameter of about 10 to 50 nm precipitated and the crystallization thereof proceeded in the thin alloy ribbon heat-treated at 640° C. for 10 min.

As seen from FIGS. 23 and 24, a number of $TbCu_7$ crystal (position 5) precipitated with no coarse particle in the thin alloy ribbon heat-treated at 640° C. for 160 min, indicating the prevention of growth of crystal grains.

The electron diffraction patterns of the position 4 of FIG. 22 and the position 6 of FIG. 24 evidently show the presence of the randomly arranged fine crystal grains. Since the nano electron diffraction patterns of the positions 4 and 6 were obtained under the irradiation diameter of 2 nm, the positions 4 and 6 were found to comprise fine crystal having an average crystal grain size of less than 2 nm and/or amorphous phase.

The composition of the $TbCu_7$ crystal phase and amorphous phase, or the $TbCu_7$ crystal phase and fine crystal having an average crystal grain size of less than 2 nm and/or amorphous phase was analyzed on the three types specimens mentioned above. The results are shown in Table 2. The analysis of the composition was carried out by TEM. As seen from Table 2, the Nb content of the quenched thin ribbon was higher in the crystal phase than in the amorphous phase. On the other hand, the Nb content of the heat-treated thin alloy ribbon was higher in the fine crystal having an average crystal grain size of less than 2 nm and/or amorphous phase than in the $TbCu_7$ crystal phase. Particularly in the thin alloy ribbon heat-treated at 640° C. for 160 min, was noted a marked phenomenon of concentration of Nb into the fine crystal having an average crystal grain size of less than 2 nm and/or amorphous phase.

In other Examples for the permanent magnetic alloy of the present invention, the $TbCu_7$ crystal phase and the fine crystal having an average crystal grain size of less than 5 nm and/or amorphous phase coexisted also in the heat-treated thin alloy ribbons. Simultaneously, M element tended to be concentrated into the fine crystal having an average crystal grain size of less than 5 nm and/or amorphous phase rather than into the $TbCu_7$ crystal phase.

By the nano electron diffraction analysis, etc., it was proved that the volume ratio of the fine crystal having an average crystal grain size of less than 5 nm and/or amorphous phase in the permanent magnetic alloy of the present invention was more than zero and less than 50% by volume, and preferably, 5 to 40% by volume in view of high practicability.

TABLE 2

| Specimen | Position of nano electron diffraction | Results of analysis | Nb Content (mass %) |
|---|---|---|---|
| After quenching | 1 | crystal phase | 3.8 |
| | 2 | amorphous phase | 3.3 |
| After heat treatment at 640° C. for 10 min | 3 | $TbCu_7$ crystal phase | 1.9 |
| | 4 | fine crystal and/or amorphous phase | 3.9 |
| After heat treatment at 640° C. for 160 min | 5 | $TbCu_7$ crystal phase | 2.0 |
| | 6 | fine crystal and/or amorphous phase | 4.5 |

Figure 25:
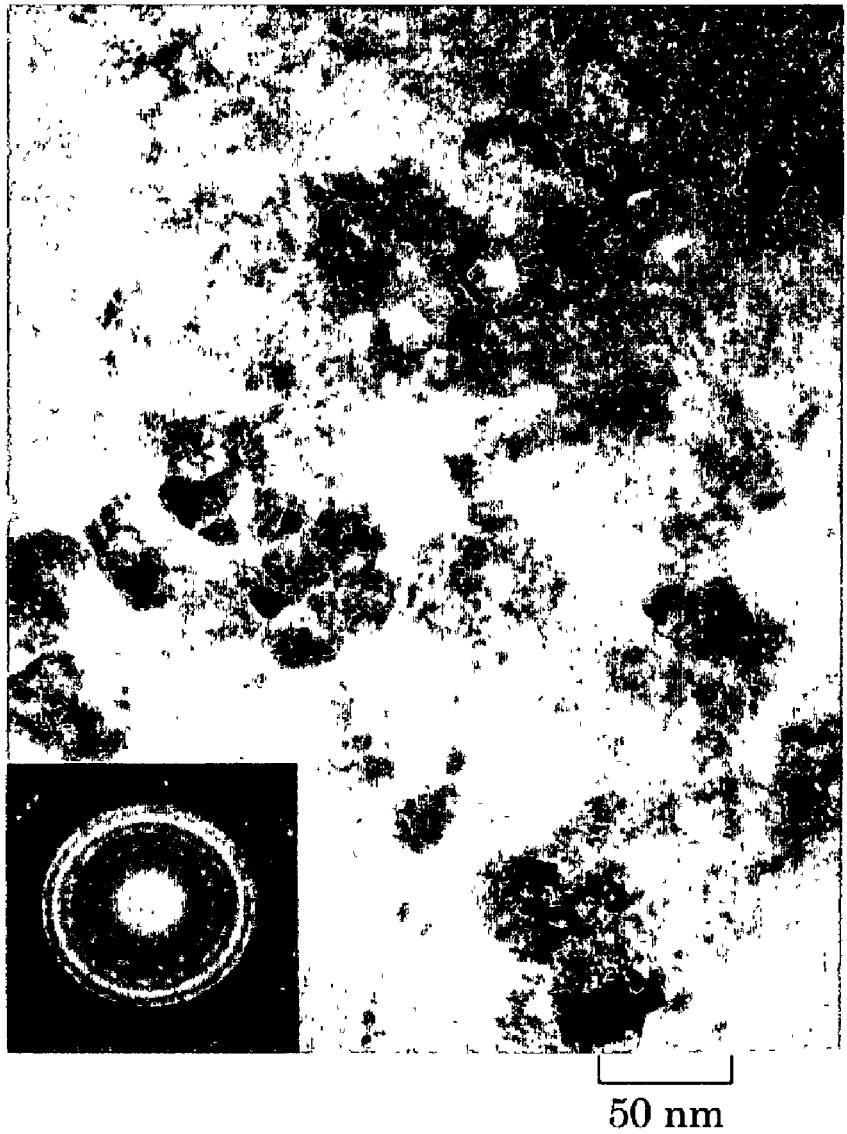
FIG. 25 is a low magnification TEM photograph showing the metal structure corresponding to FIG. 23.

FIG. 25 is a low magnification TEM photograph corresponding to FIG. 23, showing the cross section of the thin ribbon heat-treated at 640° C. for 160 min. In the lower left portion of FIG. 25, is shown a selected area electron diffraction pattern obtained by irradiating the examining field with electron beam having a spot diameter of 5 μm.

On the TEM photograph of FIG. 25, seventy-three (n) $TbCu_7$ crystal grains were arbitrarily selected to calculate the total area thereof. Specifically, a transparent sheet was put on the TEM photograph, and the portions corresponding to the selected crystal grains were cut out. From the weight of the cut-out sheet, the total are was calculated. The total cross-sectional area (s) of the seventy-three $TbCu_7$ crystal grains was found to be 32400 $nm^2$, from this value the average crystal grain size (D) being calculated to 23.8 nm by the equation (1).

EXAMPLE 14

Each quenched thin ribbon having a composition of $Sm_{6.2}Fe_{bal.}Co_{16.4}Nb_{2.7}B_{8.1}Si_{0.15}N_{0.001}$ was prepared by a single roll method while setting the peripheral speed of copper alloy cooling roll at 8, 16, 28 and 40 m/s. The quenched thin ribbon was heat-treated at 640° C. for 90 min in an argon gas atmosphere, pulverized in a mortar into powder, and classified into under-125 μm powder. Each magnetic powder was mixed with a suitable amount of acetone and a surface treating agent (silane coupling agent) in 0.25% by mass based on the magnetic powder. Then, 97.8 parts by weight of each mixed powder was mixed with 2.2 parts by weight of a 4:1 by weight mixture of an epoxy resin and a curing agent (diaminodiphenyl sulfone (DDS)). After dried at 140° C. for 1.5 h, the resultant mixture was re-classified into under-125 μm powder to obtain a molding material (compound). A mixture of 99.9 parts by weight of the molding material and 0.1 part by weight of calcium stearate was compression-molded at room temperature under a pressure of 784 MPa. The molded body was thermally cured at 170° C. for 2 h to obtain a bonded magnet of the present invention.

The density and magnetic properties at room temperature of each isotropic bonded magnet thus obtained are shown in Table 3, Nos. 51 to 54. As seen from Table 3, a density of 6.1 $Mg/m^3$ or more and a high (BH)max were attained when the bonded magnets were prepared from a thin alloy ribbon having a large thickness, namely, a thin alloy ribbon prepared by quenching at a low cooling roll peripheral speed and subsequently heat-treating.

COMPARATIVE EXAMPLE 1

A quenched thin ribbon having a composition of $Sm_{7.35}Fe_{bal.}Co_{26.5}Zr_{2.5}B_{1.9}N_{0.001}$ (B content was outside the range of the present invention) was prepared by a single roll method while setting the peripheral speed of copper alloy cooling roll at 40 m/s. Following the heat treatment, the preparation of magnetic powder, the preparation of compound, the compression molding, and the thermal curing as in Example 14, a comparative bonded magnet was obtained. The density and magnetic properties at room temperature of the bonded magnet thus obtained are shown in Table 3, No. 61. As seen from Table 3, the comparative bonded magnet was poor for practical used because of its low Hcj and (BH)max.

TABLE 3

| No. | Roll peripheral speed (m/s) | Average thickness of thin alloy ribbon (μm) | Bonded Magnet Density ($Mg/m^3$) | Br (T) (kG) | Hcj (MA/m) (kOe) | (BH)max ($kJ/m^3$) (MGOe) |
|---|---|---|---|---|---|---|
| Example 14 | | | | | | |
| 51 | 8 | 66 | 6.4 | 0.76<br>7.6 | 0.38<br>4.8 | 66.9<br>8.4 |
| 52 | 16 | 50 | 6.4 | 0.76<br>7.6 | 0.56<br>7.0 | 77.2<br>9.7 |
| 53 | 28 | 29 | 6.2 | 0.74<br>7.4 | 0.55<br>6.9 | 72.4<br>9.1 |
| 54 | 40 | 17 | 6.1 | 0.71<br>7.1 | 0.55<br>6.9 | 62.1<br>7.8 |
| Comparative Example 1 | | | | | | |
| 61 | 40 | 18 | 6.1 | 0.75<br>7.5 | 0.16<br>2.0 | 25.5<br>3.2 |

In the same manner as in Example 13, the heat-treated thin alloy ribbons of other Examples were evaluated on their cross-sectional TEM photographs. In any Examples, the average crystal grain size of the $TbCu_7$ crystal grain was found to be within the range of 5 to 80 nm.

As described above, the present invention provides a novel, high-performance rare earth permanent magnetic alloy and a bonded magnet that meet the recent severe demand for a rare earth magnetic material having high-performance magnetic properties.

What is claimed is:

1. A permanent magnetic alloy comprising an R—Fe—B alloy wherein R is at least one element selected from rare earth elements including Y, the R—Fe—B alloy having a composition mainly comprising Fe, containing N in an amount of more than 0.0001 at. % but 0.01 at. % or less and containing 4 at. % or more of B; the R—Fe—B alloy substantially comprising a $TbCu_7$ hard magnetic phase (main phase) and a fine crystal having an average crystal grain size of less than 5 nm and/or an amorphous phase; and the R—Fe—B alloy being produced by quenching a hot melt of said R—Fe—B alloy by a cooling roll method at a peripheral speed of the cooling roll within 5 to 28 m/s.

2. The permanent magnetic alloy according to claim 1, having a basic composition represented by the formula:

$$R_xFe_{100-x-y-z-w}Co_yM_wB_z$$

wherein R is at least one element selected from rare earth elements including Y and 70 at. % or more of R is occupied by Sm; M is at least one element selected from the group consisting of Nb, Ti, Zr, Hf, V, Mo, Cr and Mn; and x, y, z and w are atomic percentages satisfying $4 \leqq x \leqq 11$, $0 \leqq y \leqq 30$, $4z \leqq 11$, and $0 \leqq w \leqq 8$.

3. The permanent magnetic alloy according to claim 2, wherein a content (w) of M in the permanent magnetic alloy is $0.5 \leqq w \leqq 8$, and a content of M in the fine crystal having an average crystal grain size of less than 5 um and/or the amorphous phase is higher than a content of M in the $TbCu_7$ hard magnetic phase (main phase).

4. The permanent magnetic alloy according to claim 1, having a basic composition represented by the formula:

$$R_xFe_{100-x-y-z-w-v}Co_yM_wB_zA_v$$

wherein R is at least one element selected from rare earth elements including Y and 70 at. % or more of R is occupied by Sm; M is at least one element selected from the group consisting of Nb, Ti, Zr, Hf, V, Mo, Cr and Mn; A is Al and/or Si; and x, y, z, w and v are atomic percentages satisfying $4 \leqq x \leqq 11$ $0 \leqq y \leqq 30$, $4 \leqq z \leqq 11$, $0.5 \leqq w \leqq 8$, and $0 < v \leqq 2$.

5. The permanent magnetic alloy according to claim 1, having a basic composition represented by the formula:

$$R_xFe_{100-x-y-z-w-v-u}Co_yM_wB_zA_vN_u$$

wherein R is at least one element selected from rare earth elements including Y and 70 at. % or more of R is occupied by Sm; M is at least one element selected from the group consisting of Nb, Ti, Zr, Hf, V, Mo, Cr and Mn; A is Al and/or Si; and x, y, z, w, v and u are atomic percentages satisfying $4x \leqq 11$, $0 \leqq y \leqq 30$, $4 \leqq z \leqq 11$, $0.5 \leqq w \leqq 8$, $0 < v \leqq 2$, and $0.000 < u \leqq 0.01$.

6. The permanent magnetic alloy according to claim 1, in the form of a thin alloy ribbon having an average thickness of exceeding 30 μm, which is subjected to a heat treatment in a non-oxidative atmosphere containing substantially no nitrogen, the thin alloy ribbon containing a $TbCu_7$ hard magnetic phase (main phase) having an average crystal grain size of 5 to 80 nm, and having a coercive force Hcj of 238.7 kA/m or more at room temperature.

7. A bonded magnet comprising a permanent magnetic alloy bonded with a binder, wherein the permanent magnetic alloy comprises an R—Fe—B alloy wherein R is at least one element selected from rare earth elements including Y, the R—Fe—B alloy having a composition mainly comprising Fe, containing N in an amount of more than 0.0001 at. % but 0.01 at. % or less and containing 4 at. % or more of B; the R—Fe—B alloy substantially comprising a $TbCu_7$ hard magnetic phase (main phase) and a fine crystal having an average crystal grain size of less than 5 nm and/or an amorphous phase; and the R—Fe—B alloy being produced by quenching a hot melt of said R—Fe—B alloy by a cooling roll method at a peripheral speed of the cooling roll within 5 to 28 m/s.

* * * * *